US012480398B2

(12) United States Patent
Elmgerbi et al.

(10) Patent No.: US 12,480,398 B2
(45) Date of Patent: Nov. 25, 2025

(54) DETECTING DOWNHOLE DRILLING EVENTS

(71) Applicant: MONTANUNIVERSITÄT LEOBEN, Leoben (AT)

(72) Inventors: Asad Elmgerbi, Leoben (AT); Gerhard Thonhauser, Trofaiach (AT)

(73) Assignee: MONTANUNIVERSITÄT LEOBEN, Leoben (AT)

( * ) Notice: Subject to any disclaimer, the term of this patent is extended or adjusted under 35 U.S.C. 154(b) by 46 days.

(21) Appl. No.: 18/006,861

(22) PCT Filed: Jul. 28, 2020

(86) PCT No.: PCT/EP2020/071284
§ 371 (c)(1),
(2) Date: Jan. 25, 2023

(87) PCT Pub. No.: WO2022/022812
PCT Pub. Date: Feb. 3, 2022

(65) Prior Publication Data

US 2023/0265755 A1 Aug. 24, 2023

(51) Int. Cl.

| | |
|---|---|
| ***E21B 47/06*** | (2012.01) |
| ***E21B 21/08*** | (2006.01) |
| ***E21B 47/10*** | (2012.01) |

(52) U.S. Cl.
CPC ..... *E21B 47/06* (2013.01); *E21B 21/08* (2013.01); *E21B 47/10* (2013.01); *E21B 2200/20* (2020.05)

(58) Field of Classification Search
CPC ..... E21B 21/08; E21B 47/10; E21B 47/103; E21B 47/107; E21B 17/006; E21B 47/01
See application file for complete search history.

(56) References Cited

U.S. PATENT DOCUMENTS 3,729,986 A * 5/1973 Leonard ..... E21B 21/08 73/152.34
3,827,295 A * 8/1974 Rochon ..... E21B 21/08 73/152.22

(Continued)

FOREIGN PATENT DOCUMENTS

AU 2011334590 B2 5/2012
AU 2016222953 B2 9/2016

(Continued)

OTHER PUBLICATIONS

International Preliminary Report on Patentability for PCT/EP2020/071284, dated Feb. 10, 2023, 9 pages.

(Continued)

*Primary Examiner* — Blake Michener
(74) *Attorney, Agent, or Firm* — Womble Bond Dickinson (US) LLP

(57) ABSTRACT

An arrangement for detecting a downhole drilling event during a drilling operation by a drill pipe being partially surrounded by a tubular, wherein the arrangement comprises a sensors holder to be mounted inside of the tubular and to be mounted to surround part of the drill pipe, a plurality of sensors for sensing sensor data indicative of downhole drilling events, wherein at least part of the sensors is mounted on the sensors holder, and a processor configured for processing the sensor data to thereby detect a downhole drilling event.

12 Claims, 8 Drawing Sheets

(56) References Cited

U.S. PATENT DOCUMENTS

| | | | | |
|---|---|---|---|---|
| 4,224,988 | A * | 9/1980 | Gibson | E21B 47/11 166/250.01 |
| 5,063,776 | A * | 11/1991 | Zanker | G01F 1/002 73/152.21 |
| 5,163,029 | A * | 11/1992 | Bryant | E21B 21/08 175/48 |
| 6,768,106 | B2 | 7/2004 | Gzara et al. | |
| 9,528,334 | B2 | 12/2016 | Davis et al. | |
| 10,041,316 | B2 | 8/2018 | Dugas | |
| 10,151,159 | B2 | 12/2018 | Gottlieb et al. | |
| 10,432,194 | B2 | 10/2019 | Bar et al. | |
| 2008/0047337 | A1 | 2/2008 | Chemali et al. | |
| 2011/0024189 | A1 | 2/2011 | Saeed et al. | |
| 2012/0037361 | A1 | 2/2012 | Santos et al. | |
| 2014/0278287 | A1 | 9/2014 | Bollingham | |
| 2015/0211362 | A1 | 7/2015 | Rogers | |
| 2015/0308253 | A1* | 10/2015 | Clark | E21B 33/02 175/24 |
| 2015/0337599 | A1* | 11/2015 | Bullock | E21B 47/007 702/9 |
| 2017/0145763 | A1 | 5/2017 | Knudsen et al. | |
| 2018/0187498 | A1 | 7/2018 | Sanchez Soto et al. | |
| 2018/0328159 | A1 | 11/2018 | Mandava et al. | |
| 2018/0363394 | A1 | 12/2018 | Mei et al. | |
| 2019/0376355 | A1* | 12/2019 | Sickels | E21B 21/01 |

FOREIGN PATENT DOCUMENTS

| | | | |
|---|---|---|---|
| EP | 1898044 | A2 | 3/2008 |
| GB | 2521282 | A | 6/2015 |
| WO | WO 2015/191915 | A2 | 12/2015 |
| WO | WO 2015/191915 | A3 | 12/2015 |

OTHER PUBLICATIONS

International Search Report for PCT Application No. PCT/EP2020/071284 dated Mar. 30, 2021, 6 pages.

Written Opinion for PCT Application No. PCT/EP2020/071284 dated Mar. 30, 2021, 9 pages.

* cited by examiner

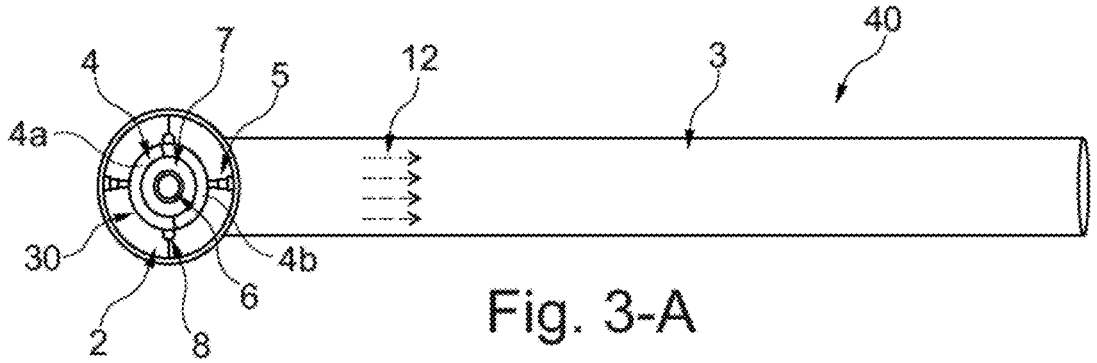
Fig. 3-A
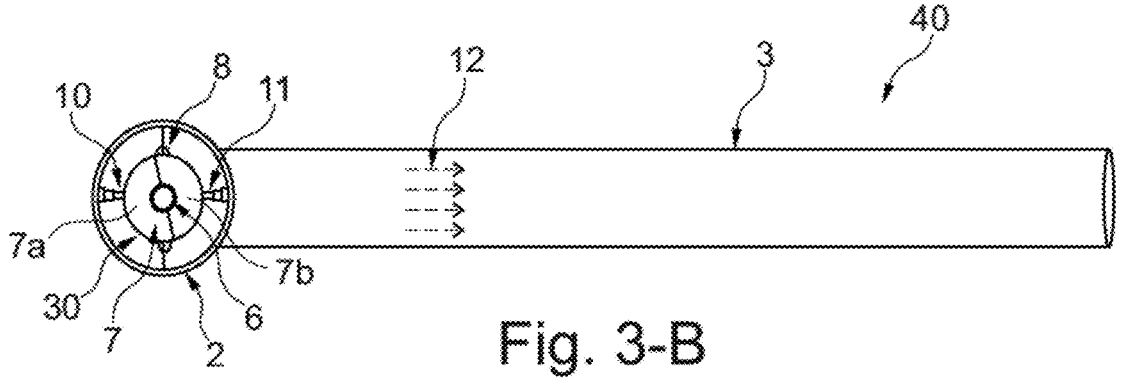
Fig. 3-B
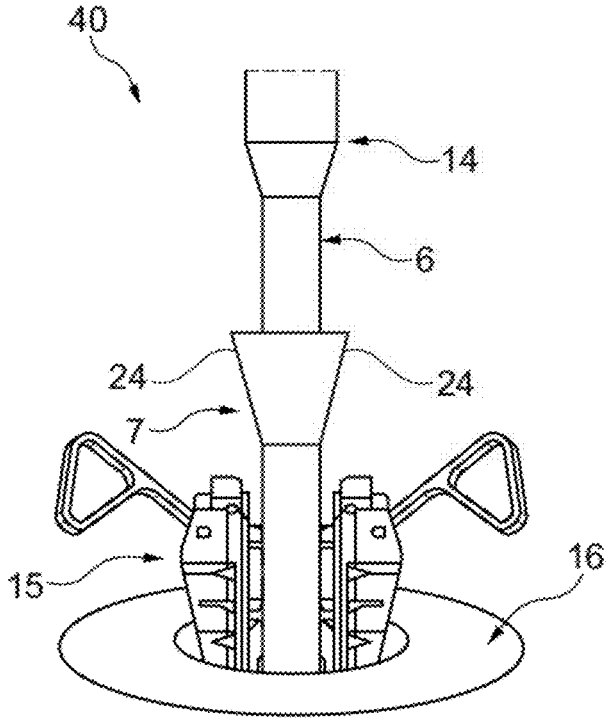
Fig. 6

DETECTING DOWNHOLE DRILLING EVENTS

This application claims the benefit of the filing date of International Patent Application PCT/EP2020/071284 filed 28 Jul. 2020, the disclosure of which is hereby incorporated herein by reference.

FIELD OF THE INVENTION

The invention relates to an arrangement for detecting a downhole drilling event, a downhole drilling apparatus, a method of detecting a downhole drilling event during a drilling operation by a drill pipe being partially surrounded by a tubular, a computer-readable medium, and a program element.

BACKGROUND OF THE INVENTION

During drilling, a drilling fluid is typically circulated through a circulation system comprising a mud pump, mud pits, mud-mixing equipment, and solid removal equipment. The circulating system is a continuous loop of travelling drilling mud during the drilling process. The fluid is pumped by a fluid pump through the interior passage of a drill string, through a drill bit and back to the surface through the annulus between the well bore and the drill string.

A primary function of the drilling fluid is to maintain a primary barrier inside the well bore to prevent formation fluids from flowing to the surface. A blow-out-preventer (BOP), which has a series of valves that may be selectively opened or closed, provides a secondary barrier to prevent formation fluids from flowing to the surface.

During oil, gas and geothermal drilling operations various unexpected events may occur which have a major impact on performance and progress of the entire operation. Such effects may affect the safety of people and environment.

It is desirable in drilling operations for certain events to be identified as soon as they occur, so that any needed remedial measures may be taken as soon as possible. Events can also be normal, expected events, in which case it would be desirable to be able to control the drilling operations based on identification of such events.

Frequently occurring events during drilling are unwanted fluid gains and losses from the well bore known as kicks and lost circulation, respectively. These two types of events in particular are considered to cause significant time and productivity losses commonly referred to as non-productive time. In addition to the aforementioned problems which can be encountered while drilling are stuck-pipe, string failure and well bore instability.

Numerous arrangements and methods for detecting the drilling problems while drilling wells or conducting well operations, workovers, completions, and interventions are known to those skilled in the art. Considering just the kick and lost circulation, most of these arrangements and methods rely on monitoring outflow measurement to identify the two events. The outflow measurement in drilling operations is usually done in conjunction with an inflow measurement in order to determine the differential flow, known as delta flow. Under normal circumstances the fluid flow rate into and out of the well bore should be the same. When a deviation is noted it is a typical indication of either fluid gain or loss. The placement of flow rate meters on the return flow line from the well bore to measure the return fluid flow has been suggested but such measurements are not necessarily accurate because the return flow line is an open channel and is not always full of fluid. Therefore, the oil and gas industry has come to distrust rig kick detection systems based on this approach.

The majority of conventional inflow measurements are done by counting the strokes of the mud pumps. By knowing the displacement volume per stroke and the efficiency of the pump the inflow volume can be determined. Other more accurate methods that use Coriolis flowmeters are mainly used in offshore operations. On the other hand, the outflow measurements are recorded at the mud return line. Depending on the blowout preventer (BOP), height and rig layout, this mud return line has different inclinations which affect the mud flow and, thus, the flow measurement.

A conventional instrument that is used on the rig to monitor the outflow is a flow paddle. Since it is installed on the return flowline quite close to the bell nipple or marine riser and before the pits, it provides quick feedback on detecting lost circulation and kick events. However, it is far from being the optimum instrument for proper loss and kick detection, as it does not measure real flow or volume of the drilling fluid. One additional element to be considered when using a flow paddle is the accumulation of the cuttings at the bottom of the flowline.

More accurate flow measuring devices are available nowadays. Still, these devices have certain limitations. While electromagnetic flowmeters work only in water based mud, other devices, such as Coriolis flowmeters, involve high effort and have a relatively big footprint. Another issue related to conventional flowmeter devices and sensors is motor- and compressor-induced vibrations, particularly on offshore platforms. These external vibrations interfere with the Coriolis flowmeter own vibrations which results in false readings.

All the mentioned approaches are used with an open system. However, for a closed-loop system (underbalanced drilling and managed pressure drilling) the return flow line is always full of fluid. Thus, installing flow rate meters on the return flow-line may provide better accuracy to detect a very small differential change in flow rate since the return flow-line is always full of fluid.

Another approach used for a closed loop system is by comparing standpipe pressure (SPP) and annular discharge pressure (ADP). The variations of the pressure at the inlet standpipe pressure and at the outlet annular discharge pressure of the system may be used to identify when the flow is being abnormally disturbed. For example, fluid loss is characterized by a decrease in standpipe and discharge pressure due to a reduction in both annulus friction pressure and discharge friction pressure as flow decreases, whereas an increase in both pressures indicates a present of a kick. Although these two methods improve the rapidity of the detection, it has several flaws and limitations. These are because of the amount of equipment that has to be installed on a rig and kept for maintenance. For the second method, it can only be applied in steady state flow conditions without any substantial pipe movement, otherwise many false alarms are generated. Furthermore, it requires relatively precise measurements, it also requires that the ADP can be measured in a proper way. In managed pressure drilling it is easy to get the ADP since the gauge is already there. However, in conventional drilling, it is necessary to put the ADP sensor upstream of an element causing enough pressure loss such that it is possible to observe the pressure variations due to the changes of the monitored flow-rate.

Considering the aforementioned difficulties associated with conventional strategies of detecting drilling problems for conventional drilling rigs (with an open system), it will be appreciated that improvements would be desirable in the art of detecting events occurring during drilling operations.

SUMMARY OF THE INVENTION

There may be a need to reliably detect downhole drilling events.

According to an exemplary embodiment of the invention, an arrangement for detecting a downhole drilling event during a drilling operation by a drill pipe being partially surrounded by a tubular (which may also be denoted as tubular body) is provided, wherein the arrangement comprises a sensors holder to be mounted inside of the tubular and to be mounted to surround part of the drill pipe, a plurality of sensors for sensing sensor data indicative of downhole drilling events, wherein at least part of the sensors is mounted on the sensors holder, and a processor configured for processing the sensor data to thereby detect a downhole drilling event.

According to another exemplary embodiment, a downhole drilling apparatus is provided, wherein the downhole drilling apparatus comprises a rotatable drill pipe configured for downhole drilling in a drill hole and for supplying drilling fluid to the drill hole, a tubular which partially surrounds the drill pipe, and an arrangement having the above-mentioned features for detecting a downhole drilling event during a drilling operation.

According to a further exemplary embodiment, a method of detecting a downhole drilling event during a drilling operation by a drill pipe being partially surrounded by a tubular (in particular using an arrangement or a downhole drilling apparatus having the above mentioned features) is provided, wherein the method comprises mounting a sensors holder inside of the tubular and around or surrounding part of the drill pipe, arranging at least part of a plurality of sensors on the sensors holder, operating the sensors for sensing sensor data indicative of downhole drilling events, and processing the sensor data to thereby detect the downhole drilling event.

According to still another exemplary embodiment of the invention, a program element (for instance a software routine, in source code or in executable code) is provided, which, when being executed by a processor (such as a microprocessor or a CPU), is adapted to control or carry out a method having the features mentioned in the following. The program element is for detecting a downhole drilling event based on sensor data sensed by a plurality of sensors during a drilling operation by a drill pipe being partially surrounded by a tubular. The program element, when being executed by one or a plurality of processors, is adapted to carry out or control a method which comprises classifying possible downhole drilling events, to be sensed by the sensors, into a plurality of issue classes each being indicative of an assigned issue level of an assigned downhole drilling event, defining one or more indexes for each of said issue classes, wherein each index corresponds to a parameter, which is detectable by the sensors, in the presence of an assigned downhole drilling event, and determining a downhole drilling event based on the sensor data, by applying a predictive model for each of the one or more indexes, and using at least one uncertainty window related to the one or more indexes.

According to yet another exemplary embodiment of the invention, a computer-readable medium (for instance a CD, a DVD, a USB stick, an SD card, a floppy disk or a hard disk, or any other (in particular also smaller) storage medium) is provided, in which a computer program is stored which, when being executed by a processor (such as a microprocessor or a CPU), is adapted to control or carry out a method having the features mentioned in the following. In said computer-readable medium, a computer program of detecting a downhole drilling event based on sensor data sensed by a plurality of sensors during a drilling operation by a drill pipe being partially surrounded by a tubular is stored, which computer program, when being executed by one or a plurality of processors, is adapted to carry out or control a method which comprises classifying possible downhole drilling events, to be sensed by the sensors, into a plurality of issue classes each being indicative of an assigned issue level of an assigned downhole drilling event, defining one or more indexes for each of said issue classes, wherein each index corresponds to a parameter, which is detectable by the sensors, in the presence of an assigned downhole drilling event, and determining a downhole drilling event based on the sensor data, by applying a predictive model for each of the one or more indexes, and using at least one uncertainty window related to the one or more indexes.

Data processing which may be performed according to embodiments of the invention can be realized by a computer program, that is by software, or by using one or more special electronic optimization circuits, that is in hardware, or in hybrid form, that is by means of software components and hardware components.

In the context of the present application, the term "downhole drilling event" may particularly denote a detectable event which may occur during performing drilling, in particular during oil, gas and/or geothermal drilling operations. In particular, such a downhole drilling event may be an undesired downhole drilling event, i.e. an event indicating an issue or a problem occurring during the downhole drilling. However, it is also possible that a detected downhole drilling event is a desired downhole drilling event or a normal downhole drilling event which is neither classified as generally desirable or undesirable. For example, during a normal operation of a downhole drilling apparatus, drilling fluid should circulate. However, in the scenario of an undesired downhole drilling event (for instance a drill pipe getting stuck), the circulation of the drilling fluid may be discontinued or at least disturbed. This can be detected by sensors.

In the context of the present application, the term "drill pipe" may particularly denote a hollow, thin-walled piping, that can be made for example of steel or aluminium alloy, and which may be used on drilling rigs. A drill pipe may be hollow to allow drilling fluid to be pumped down the hole through the bit and back up an annulus. Hence, a drill pipe may be an elongate body having a lumen through which a drill fluid can flow. At an end of the drill pipe, the drill fluid may leave the drill pipe into a well bore through one or more nozzles or other openings of the drill pipe or of the connected drill bit. The drill pipe may be configured for rotating during drilling. The drill pipe may have a drill end capable of boring underground material during downhole drilling.

In the context of the present application, the term "tubular" may particularly denote a sleeve-shaped member which may be installed in a drill hole during downhole drilling. Such a tubular may circumferentially surround a drill pipe during the drilling operation.

In the context of the present application, the term "sensors holder" may particularly denote a separate physical body to be mounted in an interior of the tubular and being specifically configured for mounting a plurality of sensors thereon, which sensors may deliver sensor data which can be used to detect a downhole drilling event. For instance, such a sensors holder may be a hollow cylindrical body.

In the context of the present application, the term "sensors for sensing sensor data" may particularly denote physical entities, at least part of which being arranged at the sensors holder or around it, and being configured for generating signals which can be processed for deriving information indicative of the presence of a specific downhole drilling event. In particular, at least two sensors may be mounted on the sensors holder.

In the context of the present application, the term "drilling fluid" may particularly denote a fluid or mud used in geotechnical engineering or the like to aid the drilling of boreholes into the earth. For instance, drilling fluid may be used while drilling oil and natural gas wells and on exploration drilling rigs. However, drilling fluids may also be used for simpler boreholes, such as water wells. One of the functions of drilling fluid is to carry cuttings out of the hole. A drilling fluid may comprise a liquid and/or a gas, optionally comprising solid particles.

In the context of the present application, the term "classifying possible downhole drilling events into issue classes" may particularly denote the process of analyzing potential or possible downhole drilling events for assigning to them a respective relevance level indicating whether an issue or a problem caused by a respective downhole drilling event is more severe or less severe. For instance, potential downhole drilling events may be classified in highly severe and moderately severe downhole drilling events. Highly severe downhole drilling events may be considered as a serious danger for a drilling process and may be assigned another consequence (for instance stopping downhole drilling) than moderately severe or less severe downhole drilling events (which may only cause a warning or an invitation to adjust the drilling process).

In the context of the present application, the term "index for an issue class" may particularly denote a parameter or a parameter value which can be detected by a sensor of a downhole drilling apparatus and which may be considered to be of specific relevance in the context of an assigned issue class being related, in turn, to a specific downhole drilling event. For instance, it may be known that a specific downhole drilling event corresponding to a respective issue class is indicated by a specific detectable parameter. For example, measurement of torque exerted to a drill pipe when the drill pipe is stuck in the well bore may be an index (here: torque) correlated to an issue or downhole drilling event (here: stuck drill pipe).

In the context of the present application, the term "predictive model" may particularly denote a statistical model used to predict the potential presence of a downhole drilling event in view of captured sensor data. In particular, the event to be predicted may be in the future, but predictive modelling can be applied to any potential downhole drilling event, regardless when it occurs (i.e. also in the past or at present). For instance, the predictive model may be chosen on the basis of detection theory to try to guess the probability of a downhole drilling event given a set amount of input sensor data, for example given a set of sensor values determining how likely they may indicate the presence of a downhole drilling event. A predictive model may be used as a basis for artificial intelligence, in particular for machine learning, for identifying the probable presence of a specific downhole drilling event in view of captured sensor data.

In the context of the present application, the term "uncertainty window" may particularly denote a one- or more-dimensional range of values of one or more detectable parameters. Parameter values within an uncertainty window may be considered as acceptable or normal, whereas parameter values outside of the uncertainty window may be considered as not acceptable or normal and may be an indication for the presence of an undesired downhole drilling event. For instance, a one dimensional uncertainty window may be defined by a range of one parameter value to be detected by a sensor (which may be connected to a sensors holder). It is however also possible that the uncertainty window is an area in a two-dimensional plane within which a combination of two parameter values may be considered to be acceptable or normal, and out of which the combination of the two detectable parameter values may be considered as not normal or not acceptable. Furthermore, an uncertainty window may also be defined by the combination of three detectable parameter values, which may result in a volume in a three-dimensional space within which the combination of the parameter values may be considered normal or acceptable, and out of which the combination of parameter values may be considered as not normal or not acceptable. An uncertainty window may also have more than three dimensions.

According to an exemplary embodiment of a first aspect of the invention, an arrangement for detecting downhole drilling events is provided in which sensors may be mounted on a separate sensors holder to be mounted in an interior of a (for instance substantially vertical) tubular of a downhole drilling apparatus and which may surround a drill pipe of the downhole drilling apparatus. By mounting sensors on such a separate sensors holder, it may be possible to detect sensor parameters or sensor data in a specific error robust way even under harsh conditions. For instance, such a configuration of assembling sensors may render the sensors less prone to failure in the presence of disturbing phenomena such as vibrations. Consequently, sensor data captured by such sensors may be a particular meaningful basis for determining as to whether a specific downhole drilling event is present or not.

According to an exemplary embodiment of a second aspect of the invention, a software for evaluating sensor data captured by sensors mounted on and/or inside of a tubular of a downhole drilling apparatus (in particular being equipped with a sensors holder, as described above) is provided. Advantageously, it is firstly possible to classify different potentially occurring downhole drilling events in accordance with multiple different issue classes. By taking this measure, it is possible to distinguish, as a basis for the software evaluation, between more critical and less critical downhole drilling events. Furthermore, it may be possible to define one or preferably multiple indexes, wherein each index or group of indexes may be assigned to a corresponding downhole drilling event by means of detectable parameters which typically occur in the presence of such an assigned downhole drilling event. Therefore, a correlation between potential downhole drilling events, their relevance or issue level, and corresponding parameters detected by the sensors may be established. Furthermore, a predictive model may be defined or designed for each index. Such a predictive model may, for instance using elements of artificial intelligence such as machine learning, be capable of making a prediction correlated with one or preferably multiple indexes. Such a predictive model may be applied by using sensor data captured during downhole drilling for detecting a present downhole drilling event. Highly advantageously, these experimentally detected sensor data may be interpreted in terms of the predictive model by additionally making use of an uncertainty window. The latter may define which parameter values or combinations of parameter values are considered to be normal or an indication for the probable presence of a certain downhole drilling event. This combination of measures has turned out as a particular reliable and powerful tool for reliably predicting the presence of downhole drilling events making use of captured sensor data and a predictive model and by using an uncertainty window.

DETAILED DESCRIPTION OF EXEMPLARY EMBODIMENTS

In the following, further exemplary embodiments of the arrangement, the downhole drilling apparatus, the method, the computer-readable medium, and the program element will be described.

A gist of an exemplary embodiment of the invention is the provision of an arrangement and a method for detecting drilling problems, or more generally considered, drilling events. More particularly, embodiments of the invention may be useful in monitoring a well during drilling and during transient periods, such as tripping in and out, running casing, logging and while cementing. This may be accomplished through measuring one or more sensor parameters, such as the volumetric flow rate, density, viscosity, temperature and/or a level of a fluid in a tubular (such as a drilling rig bell nipple or a marine riser). Highly advantageously, corresponding sensors may be mounted on a sensors holder which improves the reliability of captured sensor data due to a higher robustness against disturbing influences and artefacts such as vibrations. Exemplary embodiments of the invention may thus improve detection and verification of downhole drilling problems in real-time, and as early and accurately as possible during all drilling operations (in particular pump off and on) by continuously monitoring several flow parameters and drilling fluid related properties. An automatic prediction and improvement of diagnostic of many undesirable downhole events may thus be ensured with a negligible number of false alarms. In particular, it may be possible to eliminate the impact of the surface vibration on the measuring devices. Exemplary embodiments may be employed particularly advantageously for works on onshore and offshore drilling rigs. In particular, exemplary embodiments may improve detection of downhole drilling problems, such as losses and kicks. Furthermore, exemplary embodiments may automatically predict and improve diagnostic of undesirable downhole events with an advantageously low number of false alarms. Examples for identifiable undesirable drilling events include losses, kicks, stuck-pipe, string failure, wellbore instability, etc.

Beyond this, exemplary embodiments of the invention may provide an improved fluid flow rate measuring system which may be coupled to a sensors holder which may be installed inside a substantially vertical tubular. The fluid flowing out of the well bore may pass through the substantially vertical pipe prior to flowing to the surface via a return flow line. Thus, the fluid flow rate measurement device may be arranged and designed to measure the flow rate of fluid exiting the well bore. Arranging the fluid flow rate measuring device at or in the sensors holder may facilitate the accurate measurement of the fluid flow rate, because the annulus between the sensors holder and the substantially vertical tubular may be full of fluid when fluid is flowing therethrough. The flowing fluid may have a hydrostatic pressure acting upon it due to the fluid above the measurement point. Another advantage of the sensors holder is to work as vibration and/or shock absorber, which may help to improve the measurement accuracy of all the sensors that are mounted at the sensors holder.

It is another advantage of using a sensors holder to suppress or even eliminate the reduction of the fluid passage path. The drill pipe connections of the drill string may have a larger diameter than the surround drill pipe segments. Thus, when a drill string is disposed through the substantially vertical tubular, the annulus between the outer surface of the drill string and the inner wall of the substantially vertical tubular is reduced at the drill pipe connections which may create an unstable flow stream. This may, in turn, impact the accuracy of the sensors. According to an exemplary embodiment of the invention, the drill pipe may pass through the sensors holder, so that the cross sectional area between the substantially vertical tubular and the sensors holder does not change.

Advantageously, it may be possible to detect losses and kick events during flat time periods. The flat time periods may cover all phases when there is no actual drilling, such as while performing formation evaluation, running casings, cementing the casings, trip in and out and all other drilling activities except actual drilling activity. It may be possible to continuously monitor the fluid level inside the substantially vertical tubular by using one or more non-intrusive level and flow monitor sensors which may be advantageously located at a top of the substantially vertical tubular.

Further advantageously, it may be possible to improve the prediction of undesirable drilling events by using a pair of density and viscosity sensors. These two sensors may be coupled to the substantially vertical tubular sensor holder.

According to an exemplary embodiment of the invention, it may be possible to automatically analyse the real time data and generate alarms in case a drilling problem occurs downhole. By integrating a data-driven approach with a probability model, an uncertainty level of the results may be reduced and as a consequence the number of false alarms may be diminished.

A preferred embodiment of the invention comprises two parts, i.e. a hardware part and a software part. The hardware part and the software part may cooperate synergistically. The hardware part may include all the sensors, tools and mechanical parts. The software part may cover commands to execute a method to improve drilling efficiency by precisely detecting drilling problems on time.

A gist of an exemplary embodiment is the provision of an integrated system for real time detecting and verifying the presence of (in particular undesirable) drilling events including losses, kicks, stuck-pipe, string failure, wellbore instability, etc. In order to mitigate the impact of undesirable events while drilling, it may be highly advantageous to efficiently detect them as early as possible to be able to take the necessary action on time. Referring to kicks and losses which are considered to be particularly practically relevant downward drilling events, a highly efficient and fast detectable parameter is the outflow rate. Thus, at least not all implemented sensors or measurement devices may be mounted on a return flowline. According to an exemplary embodiment, performing the sensor measurements already at the substantially vertical tubular (such as bell nipple or marine riser) may be particularly advantageous. For instance, by continuously monitoring the level of the drilling fluid, the velocity of the drilling fluid, the density of the drilling fluid and the viscosity of the drilling fluid inside the bell nipple or marine riser, the sensor data can deliver quicker and more exact results than taking the measurements in the flowline or in the flowline only. In particular, such sensors may be mounted, at least some of them, on the sensors holder.

In an embodiment, the arrangement comprises a mounting fixture, in particular one or more arms or rods (such as a pair of rods), more particularly hydraulic rods, connected to the sensors holder and connectable or connected to the tubular. Additionally or alternatively, the downhole drilling apparatus may comprise a mounting fixture, in particular rods, more particularly hydraulic rods, connected to the tubular and connectable to the sensors holder. Any number of rods or arms is possible, in particular a single rod or arm or a plurality of rods or arms. Regarding the arms or rods mechanism, it may be hydraulic, but it may also work with another mechanism, for example a mechanically activated or electrically activated (for instance electromagnetic or motor-controlled) rods mechanism. By providing such a mounting fixture, a proper and defined mounting of the sensors holder in an interior of the tubular may be ensured. Hydraulic rods may be particularly appropriate for such a mounting purpose, wherein other embodiments may use also other kinds of rods (for example electrically actuated rods). Rods have the advantage that a resilient mounting of the sensors holder may be possible, however other kinds of mounting fixtures (for example magnetic mounting fixtures, spring-type mounting fixtures, bayonet-type mounting fixtures, lock-type mounting fixtures, screw-type mounting fixtures, pneumatic mounting fixtures, etc.) may be implemented as well.

In an embodiment, the mounting fixture (such as rods) may be connected to a top portion of the sensors holder and connectable or connected to a top portion of the tubular. In the context of the present application, the term "top portion of the tubular" may particularly denote the portion of the tubular at the highest vertical level. When being connected to an upper portion, in particular an upper end, of the sensors holder, the mounting fixture may be arranged at a position where the function of the sensors being arranged downwardly thereof are not disturbed by the mounting fixture.

In an embodiment, the (for instance rod-type) mounting fixture and the sensors holder are configured for hanging the sensors holder in the tubular. Hanging the sensors holder in the tubular by means of the mounting fixture may allow the mounting fixture to serve for damping mechanical vibrations or the like, since such kind of mounting allows the sensors holder to make some equilibration movement with respect to the tubular.

In an embodiment, the mounting fixture is connected to the sensors holder in a resilient, elastic or soft way. Additionally or alternatively, the mounting fixture may be resiliently connected to the tubular. Highly advantageously, a resilient connection between sensors holder and tubular may allow the mounting fixture to serve for equilibrating or balancing out vibrations or any other kind of mechanical shocks which may occur during downhole drilling. Thus, the mounting characteristic may be flexible or elastic rather than fully rigid.

In an embodiment, the sensors holder—and in particular also a rotatable sealing element connected or connectable with the sensors holder—is or are composed of multiple sections, in particular two bisections (such as two pivotably connected half shells), being selectively openable or closable. For instance, a drill pipe to be surrounded by the sensors holder as well as by a sealing element which may be connectable to the sensors holder (described below in further detail) may have a larger diameter, in sections thereof, as compared to the section going through the sensors holder and the optional sealing element. In order to nevertheless allow to install the drill pipe inside of the sensors holder and/or of the sealing element, it may be possible that the sensors holder and/or the sealing element is composed of two bisections or half pieces (or more than two sections) which may be operated for being closed or opened. When the (bi-) sections are opened, it may then be easily possible to move the drill pipe into or out of the well bore and longitudinally relative to the sensors holder and/or the sealing element. During sensing operation, the sensors holder and/or the sealing may then be closed.

However, as an alternative to two bisections, the sensors holder may also comprise three or more sections. The same applies to the sealing element. Hence, exemplary embodiments may use for example three trisections, four quadrosections, or even more fractioned sensors holder parts and/or sealing element parts.

For instance, the sections may be connected for instance mechanically (for example by belts or rubber rings), magnetically, by a cone connection, by an adhesive connection, etc.

In an embodiment, at least one of the sensors is mounted at each section of the sensors holder. Hence, circumferential sensing information around a circumference of the sensors holder may be obtained. This may allow to refine the determination of the presence of a certain downhole drilling event based on the captured sensor data.

In another embodiment, the sensors holder may be configured as a permanently closed sensors holder (rather than being configured to be selectively openable or closable by mutually movable sections thereof). In other words, the sensors holder can always be closed, i.e. fixed in an always closed configuration.

In an embodiment, the mounting fixture is configured for converting the sensors holder between its opened and closed configuration. For instance, the mounting fixture may, when controlled accordingly, apply a force for transferring the sensors holder and/or the sealing between a closed and an opened configuration. For this purpose, a hydraulic force may be for instance exerted by a hydraulic rod to the sensors holder and/or sealing.

In an embodiment, the arrangement comprises a biasing mechanism, in particular comprising a plurality of magnetic elements mounted on the sections (in particular bisections), configured for biasing the sections into the closed configuration. Such a biasing mechanism may hence be preferably a magnetic biasing mechanism composed of multiple magnetic elements creating an attracting force for holding the bisections of the sensors holder and/or of the sealing together in the absence of any external force. Only by actively exerting an opening force, the mounting fixture may then open the sensors holder and/or the sealing element. Such a biasing mechanism may prevent an undesired opening of the bisections, for instance by unintentional forces in an environment of the bisections.

In an embodiment, the arrangement comprises a (preferably rotatable) sealing element arranged or arrangeable at the sensors holder for at least partially sealing the sensors holder against drilling fluid. Said sealing element may prevent at least part of drilling fluid and/or at least part of mud from entering into an interior lumen of the for instance sleeve-shaped sensors holder. Thus, it may be ensured that the sensing function of the sensors mounted on the sensors holder and the substantially vertical tubular is not disturbed.

In an embodiment, the rotatable sealing element is permanently or fixedly arranged or variably arrangeable at a bottom portion of the sensors holder. Moreover, a backup rotatable sealing element may be arranged or variably arrangeable at the top or along the interior of the sensors holder. In one embodiment, the sealing element may be permanently assembled with the sensors holder. Alternatively, it is possible that the sealing element may be mounted on the sensors holder or may be selectively removed therefrom. However, the sealing element may be arranged—more generally may be permanently arranged—or variably arrangeable to be located at any point along the sensors holder.

In an embodiment, the arrangement comprises a sealing guide and/or drive mechanism configured for guiding and/or driving the rotatable sealing element to the bottom portion of the sensors holder by sliding the rotatable sealing element downward from a rig floor. In other words, the sealing element may be slid to a bottom side in order to come into functional connection with the sensors holder, and can then be fixed there. This mechanism may be an automatic mechanism carried out during operating the downhole drilling apparatus.

In an embodiment, the rotatable sealing element may have a tapering exterior surface, in particular may have a conical or frustoconical shape. By embodying the sealing element as a tapering body attached to a bottom side of the for instance sleeve-shaped sensors holder, it may be ensured that drilling fluid moving upwardly along the sealing element and thereafter along the sensors holder will not be significantly disturbed while passing said region. Consequently, the tapering and in particular conical or frustoconical configuration of the sealing element may contribute to a laminar flow of the drilling fluid around the sealing element and subsequently around the sensors holder. Furthermore, the wider end of the tapering sealing element may be connected to the for instance sleeve-shaped sensors holder, whereas the narrower end of the tapering sealing element may surround the drill pipe.

In an embodiment, the rotatable sealing element is made of or with an elastically deformable material, in particular rubber. In other words, the sealing elements may comprise or may consist of an elastically deformable material. When the sealing element is made at least partially of an elastic material, it may be possible to guide a wider or thicker portion of the drill pipe through the sealing element, even when the sealing element is not composed of two openable bisections. It is however also possible that part of the sealing element is elastically deformable, and another part of the sealing element is not elastically deformable.

In an embodiment, the connection between the sealing element and the sensors holder may allow a rotation of the sealing element, for instance together with the drill pipe while the sensors holder remains stationary fixed. Thereby, the sensors installed on the stationary sensors holder may be prevented from any disturbing effects due to a rotation thereof, so that the detected sensor data may be particularly accurate. The sealing element may however follow a rotating motion of the drill pipe to which the sealing element may be connected.

In an embodiment, the sensors comprise at least one of the group consisting of a flowmeter, a temperature sensor, a fluid viscosity sensor, a fluid density sensor, a pressure sensor (or denoted as a pressure transducer sensor). In one embodiment, a fluid viscosity sensor, and a fluid density sensor may be combined in a single fluid velocity and fluid density sensor. A flowmeter may measure a flow rate, for instance a volumetric flow rate (i.e. flowing fluid volume per time interval) or a mass flow rate (i.e. flowing fluid mass per time interval). A temperature sensor may measure a temperature in a surrounding of the sensors holder. A fluid viscosity sensor may detect viscosity of medium around the sensors holder. A pressure sensor or a pressure transducer sensor may detect a fluid pressure next to the sensors holder. All these parameters, when taken alone or in combination, may be indicative of the presence or absence of certain downhole drilling events. However, other not mentioned sensor types for one or more application relevant physical, physical-chemical or chemical parameters can be implemented as well.

In an embodiment, the sensors comprise a level sensor (or a plurality of sensors of this type), or preferably a level and flow monitor sensor (or a plurality of sensors of this type), configured for sensing a level of drilling fluid around the arrangement. A level sensor may provide level information. A level and flow monitor sensor may provide level information and may determine an amount of lost fluid or flow (and may therefore provide information how a level is moving or changing over time, i.e. may also determine level differences). Highly advantageously, a level sensor may detect the level of drilling fluid around the sensors holder or below the sensors holder. Said level may be a particular meaningful parameter for certain downhole drilling events. Detecting a fluid level may be carried out for instance by a pressure sensor, an ultrasonic sensor, a float or an optical sensor. A level sensor may be oriented so that a sensing direction extends downwardly from the sensors holder towards an interior of the well bore. Such a level sensor may provide meaningful information concerning the undesired event of a circulation interruption or stop. For instance, when the level drops significantly (for instance below a threshold value), this may indicate the undesired downhole drilling event of a loss of drilling fluid.

In an embodiment, the processor is configured for processing sensor data provided by the level and flow monitor sensor linked to a surface sensor system allowing to detect pipe movement and tripping operations, that would provide meaningful information concerning the presence or absence of a certain downhole drilling event, that may occur while moving the pipes. In particular, it may be possible to repeat a sensor measurement at constant or regular time intervals, for instance every 10 seconds. This may allow to analyse the development of the sensor signals over time, since changes of the sensor signals over time may be particularly reliable indications of the presence of an undesired downhole drilling event. For instance, it is also possible to provide redundant sensors, for instance a second sensor checking whether a first sensor works properly. This may allow to identify erroneous sensors within a sensor array.

In an embodiment, at least part (for instance at least one or at least two) of the sensors is mounted at the sensors holder. Another part (for instance at least one or at least two) of the sensors may be mounted, however, on the tubular.

In an embodiment, the sensors holder has a tubular shape. Hence, the sensors holder may be shaped as a sleeve with a central lumen. For instance, a cross-section of the tubular sensors holder may be circular or polygonal (for instance hexagonal or octagonal). A circular cross-section may be preferred in order to keep the flow of drilling fluid around the sensors holder, more precisely through an annular volume between sensors holder and tubular, as laminar as possible. The suppression of turbulent flow in this region may render the sensor data highly accurate. The above-mentioned sealing element which may be attached to a lower end of the sensors holder may seal an interior lumen of the tubular sensors holder against drilling fluid, mud, etc. However, in other embodiments the sensors holder may have any shape other than tubular.

In an embodiment, the downhole drilling event is an undesirable downhole drilling event. Hence, the sensor data may in particular indicate the presence of downhole drilling events which are considered as disturbing or even dangerous for a downhole drilling process. For instance, a detected downhole drilling event may be the event of a drill pipe being stuck in material to be drilled. Detecting such events with high accuracy provides a significant improvement of operation safety of the downhole drilling apparatus.

In an embodiment, the processor is configured for controlling or carrying out a computer program of a computer-readable medium or a program element having the above-mentioned features. In other words, the processor may be configured for executing the evaluation algorithm based on a classification of possible downhole drilling events, an assignment of one or more indexes to each potential downhole drilling event class, and the determination of a predictive model operating under consideration of one or more uncertainty windows. For instance, the processor may be a single processor, a plurality of processor units, or a part of a processor unit.

In an embodiment, the tubular is arranged substantially vertically. Such a substantially vertical tubular may be arranged inside a drilled borehole and may accommodate in its interior the sensors holder together with sensors, as well as a portion of the drill pipe.

In an embodiment, the tubular comprises or forms part of a bell nipple or a marine riser. In the context of the present application, the term "bell nipple" may particularly denote a section of a large diameter pipe fitted to the top of blowout preventers, to allow drilling fluid to flow back (for instance over shale shakers to mud tanks). In the context of the present application, the term "marine riser" may particularly denote a drilling riser, i.e. a conduit that provides a temporary extension of a subsea oil well to a surface drilling facility, which may be used with a subsea blowout preventer (BOP) and which may be used by floating drilling vessels.

In an embodiment, the tubular has a circular cross-section. Hence, the tubular may comprise a circular cylindrical sleeve. This geometry fits properly with a usually substantially cylindrical drill hole. However, other geometries of the tubular are possible, for instance a polygonal cross-section or an oval cross-section. Moreover, the tubular may have a ring-shaped or annular cross-section.

In an embodiment, part of the sensors is mounted at, on and/or within the tubular. Hence, it is possible to distribute the sensors to be partially mounted at the sensors holder and partially at the tubular. The range of sensor information derivable from such a configuration may thereby be further broadened, so that the detection of downhole drilling events may become even more precise.

In an embodiment, the downhole drilling apparatus comprises a mud return line extending from the tubular at a top portion of the sensors holder. The mud return line may branch off from the tubular in order to transport mud or drilling fluid away from the tubular. For instance, the mud return line may extend substantially horizontally from a substantially vertical tubular.

In an embodiment, the downhole drilling apparatus is configured for pumping drilling fluid through the drill pipe into the drill hole and back through an annular gap between the tubular and the sensors holder. In other words, the drilling fluid may be configured for circulating through the drill pipe, through nozzles at a bottom end thereof or more precisely of those at the drill bits, and back from there through an annulus between tubular and sensors holder.

In an embodiment, the issue classes comprise a major issue class and a minor issue class. When distinguishing between major issues, being more critical for a downhole drilling operation, and minor issues, which may have to be considered but may be less dangerous or relevant than major issues, it may be possible to further refine the determination of the downhole drilling events.

In an embodiment, the indexes comprise a main index and a secondary index. The provision of multiple indexes per issue class (for instance different indexes concerning a main issue and different indexes concerning a minor issue) allows to make the evaluation of the sensor data even more meaningful. For example, a main index may relate to a parameter which is highly typical and highly characteristic for an assigned downhole drilling event class. For instance, torque applied to a drill pipe may be a strong indicator for a stuck drill pipe. One or more secondary indexes may provide additional information or indications concerning a possible downhole drilling event, but are, in particular when taken alone, not as meaningful as the primary or main index. For the example of a stuck drill pipe, a secondary index may be a standpipe pressure.

In an embodiment, the method comprises determining the downhole drilling event by a probabilistic model which accepts a potential downhole drilling event as an actual downhole drilling event when a determined probability for the presence of the potential downhole drilling event meets a predetermined confidence criterion, in particular exceeds a predetermined confidence level. A probabilistic model may determine probabilities of the presence of certain downhole drilling events. By determining probabilities for such events, a decision whether such an event is considered to be present or not may be rendered more precise and thus more reliable. For instance, a respective confidence level may be defined which allows to quantify or help as a decision criterion whether a corresponding downhole drilling event has likely occurred, will likely occur, or is likely not present or to be expected. In particular, such a probabilistic model working on the basis of one or more predetermined confidence levels may be powerful for predictive maintenance of the downhole drilling apparatus.

In an embodiment, the predetermined confidence criterion corresponds to at least one Percentile parameter, in particular at least one of the group consisting of a P10 (wherein "P" stands for "Percentile") parameter and a P90 parameter, a P20 parameter and a P80 parameter, and a P30 parameter and a P70 parameter. When probabilistic Monte Carlo type evaluations are adopted, Px is a statistical confidence level for an estimate. Percentile Px may be defined as x % of estimates exceed the Px estimate. Hence, P90 means for example that 90% of the estimates exceed the P90 estimate. However, other definitions of a meaningful confidence level are possible as well.

In an embodiment, the predetermined confidence criterion corresponds to at least one standard deviation value of a group consisting of 0.5 values standard deviation, 1 value standard deviation, 2 values standard deviation, 3 values standard deviation, 4 values standard deviation, and 5 values standard deviation. "X values standard deviation" may relate to "X sigma standard deviation" or "X times standard deviation".

In an embodiment, the method comprises building the probabilistic model using a statistical reliability parameter of the predictive model. In other words, a statistical analysis may be carried out in terms of the determination of a potential downhole drilling event using a probabilistic model and a predictive model.

In an embodiment, the statistical reliability parameter comprises at least one of the group consisting of root mean square error, R-squared, adjusted R-squared, root mean squared logarithmic error, and mean absolute error.

The root mean square error is a measure of the differences between values predicted by a model and the values observed. More specifically, the root mean square error represents the square root of the second sample moment of the differences between predicted values and observed values or the quadratic mean of these differences. Root mean squared logarithmic error can be denoted as a logarithmic variation of the root mean square error.

R-squared is a statistical measure that represents the proportion of the variance for a dependent variable that is explained by an independent variable or variables in a regression model. While R-squared can be expressed as a percentage between zero and 100, with 100 signaling perfect correlation and zero no correlation at all, adjusted R-squared can provide an even more precise view of that correlation by also considering how many independent variables are added to a particular model against which an index is measured.

Mean absolute error is a measure of errors between paired observations expressing the same phenomenon. Mean absolute error is thus an arithmetic average of the absolute errors prediction values and true values.

However, other statistical reliability parameters may be implemented as well, additionally or alternatively.

In an embodiment, the method comprises generating the at least one uncertainty window based on a predictive value of the at least one index and based on the probabilistic model, and determining the downhole drilling event based on a comparison of an actual value of the at least one index with the at least one uncertainty window. In such a context, it may be possible to pre-process the sensor data to determine physical, physical-chemical or chemical parameters and to check then whether or not the various detected physical, physical-chemical or chemical parameters are within or without ranges which define the respective uncertainty window. The probabilistic model may then evaluate whether there is a sufficient probability, in view of potential percentage of detected physical, physical-chemical or chemical parameters being outside of the uncertainty window, to assume a presence of a downhole drilling event, or not.

In an embodiment, the at least one uncertainty window is a multi-dimensional uncertainty window. In a one-dimensional uncertainty window, it may simply be determined whether a detected parameter value is within a range of acceptable or normal values within the uncertainty window, or not. If the uncertainty window is two-dimensional, three-dimensional or of an even higher number of dimensions, two, three or more different parameters may be considered to be inside or outside a respective dimension of the multi-dimensional uncertainty window. For the example of a two-dimensional uncertainty window, a two-dimensional area may be defined by a closed uncertainty boundary line which separates combinations of parameter values inside and outside of the uncertainty window. FIG. 14 shows an example of a two-dimensional uncertainty window. The higher the dimension of the uncertainty window, the better the correlation between the different physical, physical-chemical or chemical parameters can be considered, and the higher is the reliability of the determination of the presence or absence of a specific downhole drilling event.

In an embodiment, the method comprises triggering, depending on a determined downhole drilling event, an action of a group consisting of "continue drilling" when no undesirable downhole drilling event is detected, "stop drilling" when an undesirable downhole drilling event is detected, and "output an alarm" when an undesirable downhole drilling event is detected. However, any other actions as a consequence of a determination result of determining the presence of a downhole drilling event are possible as well.

In an embodiment, the method comprises increasing an alarm count or counter each time a value of an index detected by the sensors is outside of the at least one uncertainty window, and triggering an alarm when a level of the alarm count or counter exceeds a predetermined threshold value. In particular, the method may comprise the use of a counting loop for triggering an action, in particular for triggering an alarm. More particularly, the method may comprise triggering the action when a number of index based events counted by the counting loop reaches or exceeds a predetermined number. Hence, a counter may be implemented which counts a number of detected data points (i.e. detected by the sensors) which are situated outside of the uncertainty window. A threshold value may then be defined which indicates up to which number of counts the presence of a downhole drilling event is not considered, while considering the presence of said downhole drilling event when the number of counts exceeds the threshold value. Establishing such a counter may allow to obtain more meaningful results in terms of determination of a downhole drilling event, i.e. may reduce the number of false positives and/or false negatives. In an embodiment, the method comprises generating (in particular integrated and classified) one dimensional uncertainty windows, wherein each uncertainty window corresponds to one confidence criterion. Additionally or alternatively, the method comprises generating (in particular integrated and classified) multi-dimensional uncertainty windows, wherein each uncertainty window corresponds to one confidence criterion.

BRIEF DESCRIPTION OF THE DRAWINGS

The invention will be described in more detail hereinafter with reference to examples of embodiment but to which the invention is not limited:

FIG. 3-A is a top view of the downhole drilling apparatus of FIG. 1.

FIG. 3-B depicts a bottom view of the downhole drilling apparatus of FIG. 1.

FIG. 6 shows a sectional view of installing a low pressure rotating sealing element according to another exemplary embodiment of the invention.

DETAILED DESCRIPTION OF THE DRAWINGS

Figure 1:
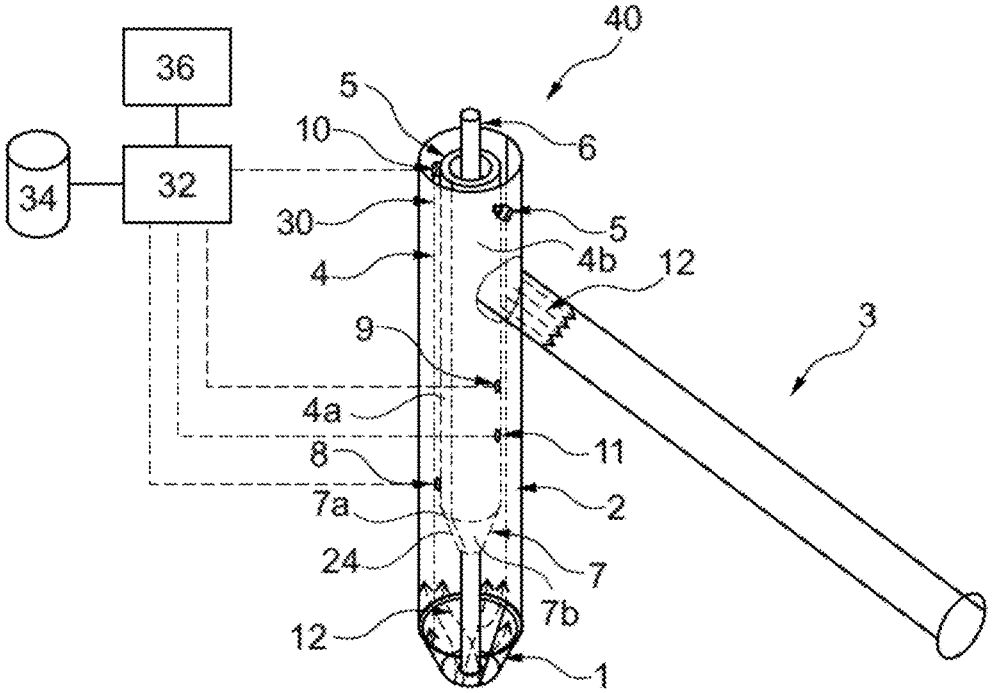
FIG. 1 illustrates a three-dimensional view of a downhole drilling apparatus according to an embodiment of the invention, and in particular shows a preferred implementation of the downhole drilling apparatus on a land and offshore rig which includes flow rate and temperature measurement sensors coupled to the sensors holder and density and viscosity sensors coupled to a substantially vertical tubular.

The illustrations in the drawings are schematically. In different drawings similar or identical elements are provided with the same reference signs.

Before exemplary embodiments of the invention will be described in more detail referring to the figures, some basic consideration underlying the present invention will be described based on which exemplary embodiments of the invention have been developed.

An exemplary embodiment of the invention relates to an arrangement for and a method of detecting drilling events, and in particular downward drilling problems. More particularly, an exemplary embodiment of the invention enables monitoring of a well during drilling and during transient periods (such as tripping in and out, running casing, logging and while cementing) through measuring physical parameters such as the volumetric flow rate, density, viscosity, temperature and level, or physical-chemical or chemical parameters of a fluid in a drilling rig bell nipple or marine riser.

More particularly, this may make a real time detection and verification of the presence of downhole drilling events possible, such as undesirable drilling events including losses, kicks, stuck-pipe, string failure, or well bore instability. In order to mitigate the impact of undesirable events while drilling, it may be advantageous to efficiently detect them as early as possible to be able to take the necessary action on time. Relevant surface parameters which may be used to detect aforementioned events are in particular mud pit volume, return flow rate, torque and/or standpipe pressure. What concerns kicks and losses as highly relevant downhole drilling events, a particular efficient and fast source to detect and identify them is the outflow rate. Advantageously, corresponding sensor measurements may be carried out at a sensors holder and at a substantially vertical tubular such as bell nipple or marine riser according to an exemplary embodiment of the invention. This may allow to continuously monitor physical, physical-chemical or chemical parameters such as the drilling fluid's level, velocity, density and viscosity inside the bell nipple or marine riser. Corresponding sensor results can deliver a quick and precise indication of the presence of a downhole drilling event. Preferably, a combination of sensors and sensor arrays, which may be at least partially mounted on a sensors holder, may comprises one, some or all of the following five kinds of sensors: level and flow monitor sensor, velocity sensor, density sensor, viscosity sensor and temperature sensor. All the sensors may be positioned inside the bell nipple or marine riser and at the sensor holder, which may be a part of the bell nipple or marine riser or may be connected thereto.

Figure 2:
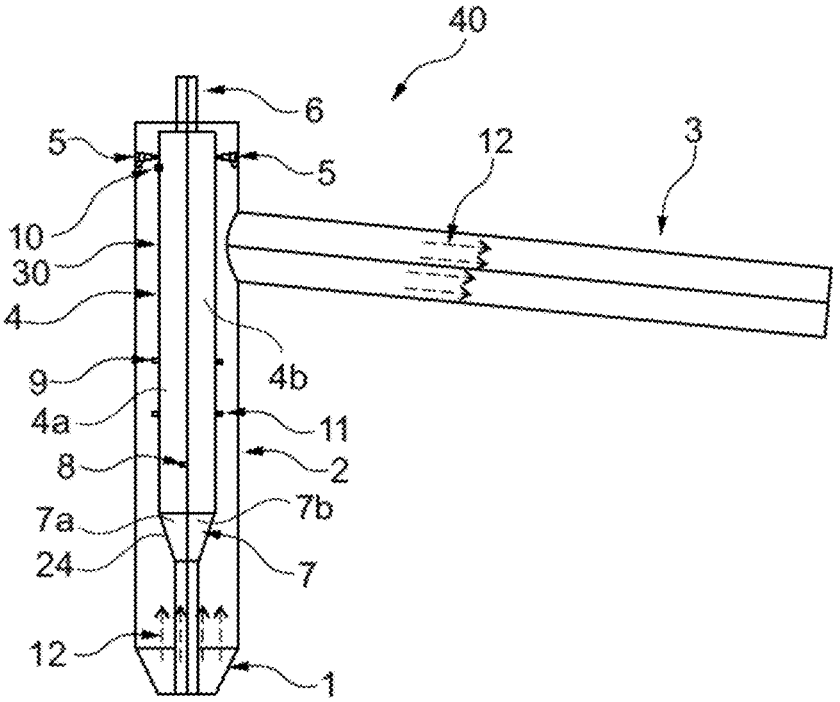
FIG. 2 is a cross-sectional view of the downhole drilling apparatus according to FIG. 1 illustrating fittings of utilized sensors, the position of a sensors holder, a rotating sealing element and hydraulic arms or rods.

An exemplary embodiment of a downhole drilling apparatus 40 comprising an arrangement 30 for detecting downward drilling events will be described in the following referring to FIG. 1 to FIG. 6. In other words, mechanical components involved in a downhole drilling apparatus 40 according to exemplary embodiments of the invention are illustrated in FIG. 1, FIG. 2, FIG. 3-A, FIG. 3-B, FIG. 4, FIG. 5 and FIG. 6.

The illustrated downhole drilling apparatus 40 comprises a rotatable drill pipe 6 configured for downhole drilling in a drill hole and for supplying drilling fluid to the drill hole. Only part of drill pipe 6 is shown in the figures. A tubular 2 with a circular cross-section, which may be embodied as a bell nipple or a marine riser, surrounds part of the drill pipe 6. As shown, the tubular 2 may be arranged vertically or substantially vertically.

Sensors 8-11 used for detecting downhole drilling events are mounted at the tubular 2 and at a sensors holder 4 (which will be described below in further detail). For instance, the mentioned sensors 8-11 may comprise a flowmeter 11, a temperature sensor 9, a viscosity sensor 8, a pressure sensor, etc. Preferably, the sensors 8-11 also comprise a level and flow monitor sensor 10 configured for sensing a level of drilling fluid 12 around the arrangement 30. In this context, a processor 32 (described below in further detail) may be configured for processing sensor data provided by the level sensor 10 linked with surface data indicative of a surface level. Sensor signals or sensor data detected by the sensors 8-11 may be transmitted to the processor 32 for processing. As shown, part of the sensors 8-11 is mounted at the sensors holder 4, while another part of the sensors 8-11 is mounted at the tubular 2.

Furthermore, a mud return line 3 is shown which extends substantially horizontally from the tubular 2 where the top portion of the sensors holder 4 is situated. The illustrated downhole drilling apparatus 40 is configured for pumping drilling fluid 12 through the drill pipe 6 into the drill hole and back through an annular gap between the tubular 2 and the sensors holder 4 into the mud return line 3.

The arrangement 30 serves for detecting a downhole drilling event during a drilling operation by drill pipe 6 and comprises the above-mentioned sensors holder 4 which is mounted inside of the tubular 2. At least a part of the sensors 8-11 is mounted or assembled on the sensors holder 4 for sensing sensor data indicative of downhole drilling events. The sensors holder 4 may have a tubular shape with circular cross-section. At least part of the sensors 8-11 may be mounted at an exterior surface of the sensors holder 4.

FIG. 1 furthermore illustrates schematically processor 32 which may also function as a control unit for controlling operation of downhole drilling apparatus 40 or part thereof. Processor 32 is configured for processing the sensor data to thereby detect a downhole drilling event. Processor 32 may access a database 34 which may store software code for carrying out a software-based method of detecting a downhole drilling event. Processor 32 may be provided, for this purpose, also with sensor data captured by sensors 8-11.

More specifically, the processor 32 may be configured for controlling or carrying out a computer program of a computer-readable medium or a program element, as described below. Corresponding program code may also be stored in database 34 and may thus be accessible for processor 32. Furthermore, processor 32 may be communicatively coupled with an optional user interface 36. Via the user interface 36, which may also be denoted as input/output unit, a user may input control commands and may be provided with results of the sensor-based determination of a downhole drilling event.

Furthermore, arrangement 30 comprises a pair of hydraulic rods 5 which are arranged at two opposing sides of the sensors holder 4 and are connected to the sensors holder 4 and to the tubular 2. As an alternative to rods 5, another mounting fixture for mounting the sensors holder 4 at tubular 2 may be implemented as well. The illustrated rods 5 are connected to a top portion of the sensors holder 4 and to a top portion of the tubular 2. Moreover, the rods 5 and the sensors holder 4 are configured for hanging the sensors holder 4 in the tubular 2 so that the sensors holder 4 may carry out, to a limited degree, an equilibration motion for equilibrating mechanical shocks or vibrations from the environment. The mentioned rods 5 (as an example of a mounting fixture) are resiliently connected to the sensors holder 4 to serve as a shock absorber or damping unit for damping vibrations, to thereby protect the sensors 8-11 against an undesired impact which might otherwise deteriorate the sensor accuracy.

Beyond this, the sensors holder 4 and also a rotatable sealing element 7 (described below in further detail) connected with the sensors holder 4 are composed of two bisections 4*a*, 4*b* being selectively openable or closable (the figures show a closed configuration). Each bisection 4*a*, 4*b* of the sensors holder 4 may be equipped with at least one of the sensors 8-11. Advantageously, the rods 5 may be configured for converting the sensors holder 4 between its opened and closed configuration, in particular by pivoting its bisections 4*a*, 4*b* relative to each other. In order to prevent an undesired unintentional opening of the sensors holder 4 during operation of the downhole drilling apparatus 40, a biasing mechanism may be provided in form of a plurality of magnetic elements 13 mounted on the bisections 4*a*, 4*b*. Said magnetic elements 13 (for instance magnetic plates) may create an adhesive force and may thereby bias the bisections 4*a*, 4*b* of the sensors holder 4 into the shown closed configuration.

As already mentioned, arrangement 30 comprises sealing element 7 which is arranged at a bottom side of the sensors holder 4 for partially or entirely sealing the sensors holder 4 against drilling fluid 12. Said rotatable sealing element 7 is rotatable with regard to the sensors holder 4. The rotatable sealing element 7 may be permanently arranged at a bottom portion of the sensors holder 4 (for instance FIG. 1 and FIG. 2).

In another embodiment, the rotatable sealing element 7 may be variably movable between a bottom portion of the sensors holder 4 and another position (see FIG. 6). Referring to FIG. 6 which is described below in more detail, a sealing drive and/or guide mechanism may be provided which is configured for driving and/or guiding the rotatable sealing element 7 to the bottom portion of the sensors holder 4 by sliding the rotatable sealing element 7 downward from a rig floor 16.

Figure 5:
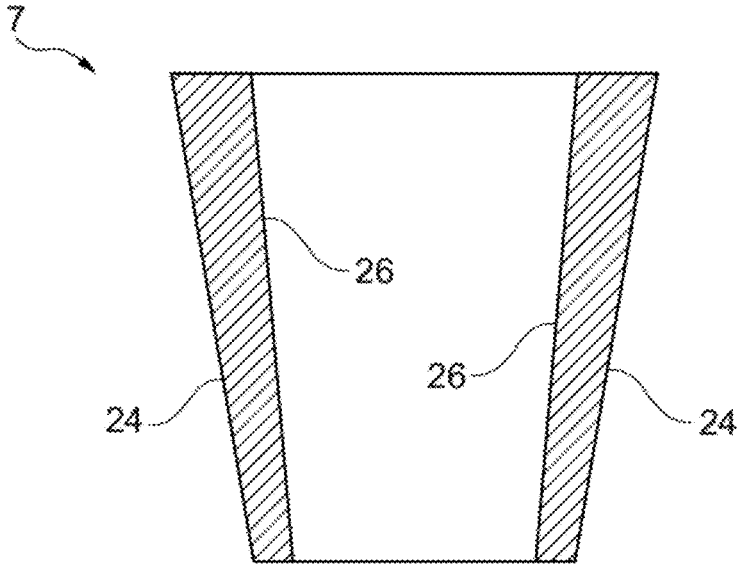
FIG. 5 illustrates a cross-sectional view of a low pressure rotating sealing element of an arrangement according to an exemplary embodiment of the invention.

As best seen in FIG. 1, FIG. 2 and FIG. 5, the rotatable sealing element 7 may be hollow and may be provided with a tapering exterior surface 24 tapering downwardly, in particular may have a conical or frustoconical shape. For instance, the rotatable sealing element 7 is made of an elastic material such as rubber. Advantageously, the sealing element 7 may be rotatable with respect to the stationary sensors holder 4 and may simultaneously rotate together with the rotatable drill pipe 6 to which the sealing element 7 may be connected at its bottom side. In order to enable such a relative rotation between sensors holder 4 and sealing element 7, it is for instance possible to arrange a bearing (such as a ball bearing) at an interface between sensors holder 4 and sealing element 7.

Now referring to FIG. 1 to FIG. 6 in further detail, hollow cylindrical tubular 2 is inserted on the top of a Blowout preventer (BOP). Sensors holder 4 may be mounted on the tubular 2 using a mounting fixture such as the hydraulic rods 5. Drilling fluid 12 may be pumped downwardly through drill pipe 6 mounted partially inside of sensors holder 4. The drilling fluid 12 may flow out of one or more nozzles at a bottom end of the drill pipe 6 or of the drill bit (not shown in FIG. 1). The drilling fluid 12 may move again upwardly through an annular space between tubular 2 and sensors holder 4. For instance, an inner diameter of sensors holder 4 may be 5 inch, whereas a thickest portion (not shown) of the drill pipe 6 may have a diameter of 7 inch. In order to allow motion of drill pipe 6 into or out of the well bore without removing sensors holder 4, it may be possible to open or close two bisections 4*a*, 4*b* of the sensors holder 4. Each bisection 4*a*, 4*b* may have a half circular shaped cross-section. Opening and closing the sensors holder 4 may be accomplished by correspondingly actuating the hydraulic rods 5. Correspondingly, also rotatable sealing element 7 may be selectively openable or closable, by separating two bisections 7*a*, 7*b* thereof controlled by a mounting fixture such as the hydraulic rods 5. This may allow to guide the drill pipe 6 with its thickest portions also through tapering sealing element 7. Additionally or alternatively, sealing element 7 may be made of a deformable material such as rubber so that the drill pipe 6 may be forced through the elastically deformable sealing element 7 also without closing two bisections 7*a*, 7*b* thereof. Sealing element 7 may be rotatable together with drill pipe 6, while sensors holder 4 remains substantially spatially fixed.

The described configuration allows to provide a sealing function by sealing element 7 preventing drilling fluid 12 from entering an interior lumen of the tubular sensors holder 4. For instance, a lower end of sealing element 7 may surround drill pipe 6 with physical contact, and an upper end of sealing element 7 may be connected continuously and with physical contact to a lower end of the tubular sensors holder 4. Furthermore, the tapering geometry of the sealing element 7 may ensure that drilling fluid 12 moves upwardly along an exterior of the sealing element 7 and along an exterior of the sensors holder 4 in a laminar rather than turbulent fashion. Hence, substantially no turbulences will disturb sensors 8-11 mounted on an exterior side of the sensors holder 4 and/or on an interior side of the tubular 2. As shown as well in FIG. 1, drilling fluid moving back upwardly through the ring gap between tubular 2 and sensors holder 4 may move into mud return line 3 branched off horizontally from tubular 2 close to an upper end of sensors holder 4.

An additional sealing element (not shown) may be installed at the top of the sensors holder 4 or along the sensors holder 4 at any point between top and bottom part for providing additional sealing or isolation and to work as backup in case an additional sealing in addition to the sealing function of the main sealing element 7 is desired.

Advantageously, the upper side of sensors holder 4 is mounted only resiliently or flexibly on the mounting fixture which is here embodied in form of hydraulic rods 5, so that mechanical shocks or vibrations may be prevented from deteriorating the function of the part of the sensors 8-11 which may be mounted on the sensors holder 4. More specifically, at least some of sensors 8-11 may be exposed at an outer side of the sensors holder 4 so that the rods 5 do not influence the sensors 8-11. The resilient mounting fixture being here embodied as rods 5 functions as shock absorber for absorbing shocks and vibrations, to thereby prevent the sensors 8-11 from malfunction.

A free end of the mud return line 3, which is shown on the right-hand side of FIG. 1, may be open to atmosphere. In the mud return line 3, mud, cuttings and drilling fluid 12 may be transported. Arranging sensors 8-11 not in mud return line 3, but at sensors holder 4 and/or in an interior of tubular 2 may prevent the sensors 8-11 from any undesired impact by cutting and changing pressure conditions. Advantageously, the drilling fluid 12 is in a substantially stable configuration at the positions of sensors 8-11, and advantageously the sensors 8-11 see drilling fluid 12 moving in one direction only. At the end of the drill pipe 6 (not shown in FIG. 1), a drill bit may be arranged which cuts the underground and guides drilling fluid 12 through nozzles. Sealing element 7 seals (at least to a certain degree) against drilling fluid 12 and converts the flow and influences the flow of the drilling fluid 12 to avoid turbulence. By ensuring a laminar flow, a better sensor performance can be obtained.

While sensors holder 4 and tubular 2 are preferably made of steel, sealing element 7 can be made of steel or alternatively of an elastic or resilient material such as rubber. Without sealing element 7, backflow of drilling fluid 12 might enter an interior lumen of sensors holder 4. This can be prevented at least partially by sealing element 7 with the shown configuration. Furthermore, sealing element 7 centers drill pipe 6 and ensures a smooth laminar flow of drilling fluid 12 around sensors holder 4. A flexible or elastic, not completely rigid configuration of sealing element 7 ensures that drill pipe 6 can move through sealing element 7.

Turning again to FIG. 1, a drilling rig is shown which comprises the substantially vertical tubular 2. The substantially vertical tubular 2 comprises a large diameter pipe, which has mud return line 3 protruding from it.

In use, the substantially vertical tubular 2 may be fitted to the top of blow out preventers (which are not shown in the drawings) via flange 1 when drilling for hydrocarbon or the like. Drill pipe 6 passes coaxially through the substantially vertical tubular 2. During drilling, drilling fluid 12 is pumped down into the drill hole through the drill pipe 6 and returns to the surface. When the drilling fluid 12 enters the substantially vertical tubular 2, that drilling fluid 12 flows through the annular cavity between the outer periphery of the drill pipe 6 and the inner wall of the substantially vertical tubular 2 until it reaches the mud return line 3. The drilling fluid 12 then flows out along the mud return line 3.

Mud return flow-line 3 is generally not full of fluid, and this condition may conventionally cause inaccuracies in measurements when taking place at mud return flow-line 3 (not shown). Furthermore, installing measurement devices such as one or more flow rate meters 11, one or more temperature sensors 9 or any tool having a performance which depends on vibration intensity outside of the substantially vertical tubular 2 may cause inaccuracies in measurements due to the existence of mechanical vibration caused by drilling operations. Other downsides of performing the measurements by mounting such devices at the outer diameter of the substantially vertical tubular 2 are that the drilling fluid 12 moves in two opposite directions, i.e. downward along the drill pipe 6 and upward through the annular cavity between the outer periphery of the drill pipe 6 and the inner wall of the substantially vertical tubular 2. Due to the existence of these obverse movements of the drilling fluid 12, inappropriate environment and restrictions may be created for several devices. In other words, several conventionally installed sensors 8-11 may not perform properly. Concerning the flow rate measurement device, the drill pipe 6 is comprised of drill pipe segments coupled via drill pipe connections. The drill pipe connections may have larger outer diameters than the outer diameters of the adjacent drill pipe segments. Thus, when the drill pipe 6 moves up and down within the substantially vertical tubular 2, an annular space is created between the outer surface of the drill string and the inner diameter of the substantially vertical tubular 2. However, the annular space surrounding the drill pipe connections may be less than the annular space surrounding the drill pipe segments between drill pipe connections. Because there is less annular space surrounding the drill pipe connections, the fluid velocity through the annulus of the substantially vertical tubular 2 has to increase in the vicinity of the drill pipe connections in order to maintain a constant volumetric flow rate through the substantially vertical tubular 2. Subsequently, unstable flow pattern conditions may develop which in turn may significantly influence the accuracy of the measurements.

According to preferred embodiments of the invention, sensors holder 4 hanged inside the substantially vertical tubular 2 by an appropriate mount fixture such as hydraulic rods 5 may be located at the top of substantially vertical tubular 2 to overcome the above-mentioned and/or other shortcomings.

Figure 4:
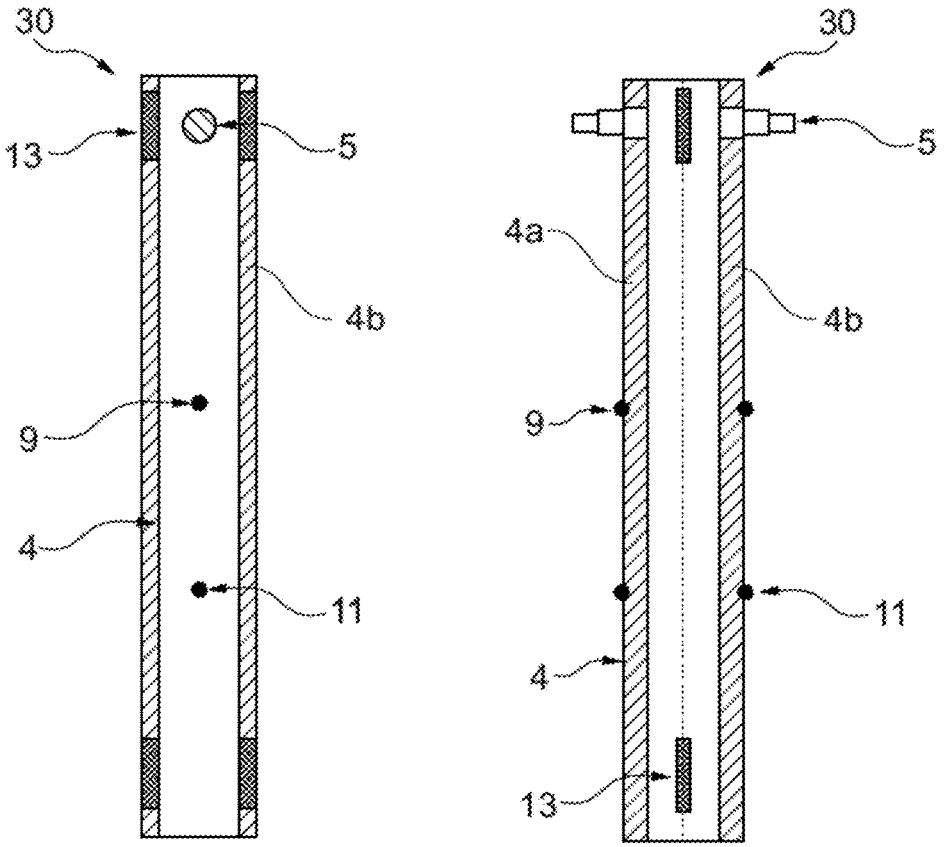
FIG. 4 depicts cross-sectional views of sensor holders of an arrangement according to an exemplary embodiment of the invention in accordance with two perpendicular planes.

As best seen in FIG. 4, the sensors holder 4 may be composed of two bisections 4*a*, 4*b* or halves which may be embodied as a circular shaped pipe, which allow the sensors holder 4 to be open and closed. While tripping bottom hole assembly (BHA) in or out, or running casings (elements not shown here), the sensors holder 4 may be in open position, so that the BHA and the casing can be moved up or down while crossing the substantially vertical tubular 2 without obstacles. In other operation modes, the sensors holder 4 may be in closed position.

Opening and closing movements of the sensors holder 4 may be done or triggered by the hydraulic rods 5. In case of a closed status, a pair of magnetic elements 13 located at the top and the bottom of each half of the sensors holder 4 may align. A function of these magnetic elements 13 is to reinforce the stability of the sensors holder 4. Because the sensors holder 4 has a uniform outer diameter in the shown embodiment, as the drilling fluid 12 moves in the annular space between substantially vertical tubular 2 and sensors holder 4, no disturbance to drilling fluid 12 streamlines may be caused. Thus, a precise measurement can be carried out by sensors 9, 11 coupled with the sensors holders 4 and by sensor 8 built-up inside the body of substantially vertical tubular 2.

In one embodiment of the invention, low pressure rotating sealing element 7 is integrated to lower part of the sensors holder. As shown in FIG. 5, low pressure rotating sealing element 7, when in its closed position, has a hollow cone shape, wherein its upper internal diameter may be larger than its lower internal diameter. Sealing element 7 may have a tapering exterior surface 24 and a tapering interior surface 26. Like the sensors holder 4, low pressure rotating sealing element 7 can be in two positions, closed and open. While tripping bottom hole assembly (BHA) in or out, or running casings (elements not shown here), the low pressure rotating sealing element 7 may be in open position, so that the BHA and the casing can be moved up or down while crossing the substantially vertical tubular 2 without obstacles. Otherwise the low pressure rotating sealing element 7 may be in the closed position.

In case of the closed status of sealing element 7 and the drill pipe 6 being in a rotating mode, the low pressure rotating sealing element 7 may rotate simultaneously and independently from the sensors holder 4 which does not rotate intentionally. The low pressure rotating sealing element 7 may be made by a material that has elastic feature, such as rubber. By configuring the low pressure rotating sealing element 7 to be elastically deformable, it may be possible to allow drill pipe connections to pass through the sealing element 7 while drilling or while tripping in and out.

According to an alternative preferred embodiment of the invention and referring to FIG. 6, it may also be possible to position the low pressure rotating sealing element 7 in place (which is at the lower part of the sensors holder 4) by sliding it down from the rig floor 16. In such an embodiment, sensors holder 4 may be brought into a closed position, and the drill pipe 6 can be gripped by slip 15. Then the low pressure rotating sealing element 7 may be closed around the top part of the drill pipe 6. As soon as the slip 15 is removed and the drill pipe 6 starts to move down, the low pressure rotating sealing element 7 may start to move downwards simultaneously. Upon reaching the lower part of the sensors holder 4, due to an internal profile of sensors holder 4, the low pressure rotating sealing element 7 may be disabled from moving down freely, however drill pipe 6 can still move down. As drill pipe 6 continuously moves down, it may pass through the low pressure rotating sealing element 7, until drill pipe connection 14 comes into contact with the low pressure rotating sealing element 7. Then, the low pressure rotating sealing element 7 may start to move down by the force applied via the drill pipe connection 14. This force may make the low pressure rotating sealing element 7 to be locked in place.

According to an exemplary embodiment of the invention, a plurality of sensors 8-11 may be built directly into and/or onto the body of the sensors holder 4 and the body of substantially vertical tubular 2. As best seen in FIG. 1 and FIG. 2, a plurality of multiphase flowmeters 11 and a plurality of temperature sensors 9 may be arranged in each bisection 4*a*, 4*b* of the sensors holder 4, whereas a plurality of density and viscosity sensors 8 may be installed in the substantially vertical tubular 2. Preferably, this may be performed in a way that the angle between them is 180° and in the opposite direction of the multiphase flowmeters 11 and temperature sensors 9. In order to ascertain the detection and verification of the loss and kick events during drilling and during the flat time periods, preferred embodiments of the invention may utilize a pair of level and flow monitor measurement devices 10. Level and flow monitor measurement devices 10 may be mounted to the hydraulic rods 5 at a known or predefined distance from the end of the hydraulic rods 5 which are connected to the substantially vertical tubular 2.

The described sensors 8-11 are particularly appropriate to confirm two main undesirable events, i.e. kick and loss. However, by the help of other sensors in the rig, the sensors can also help to detect other unwanted events.

An exemplary embodiment of a software for evaluating sensor data obtained from downhole drilling apparatus 40 (for instance according to FIG. 1 to FIG. 6) will be described in the following referring to FIG. 7 to FIG. 14.

Figure 7:
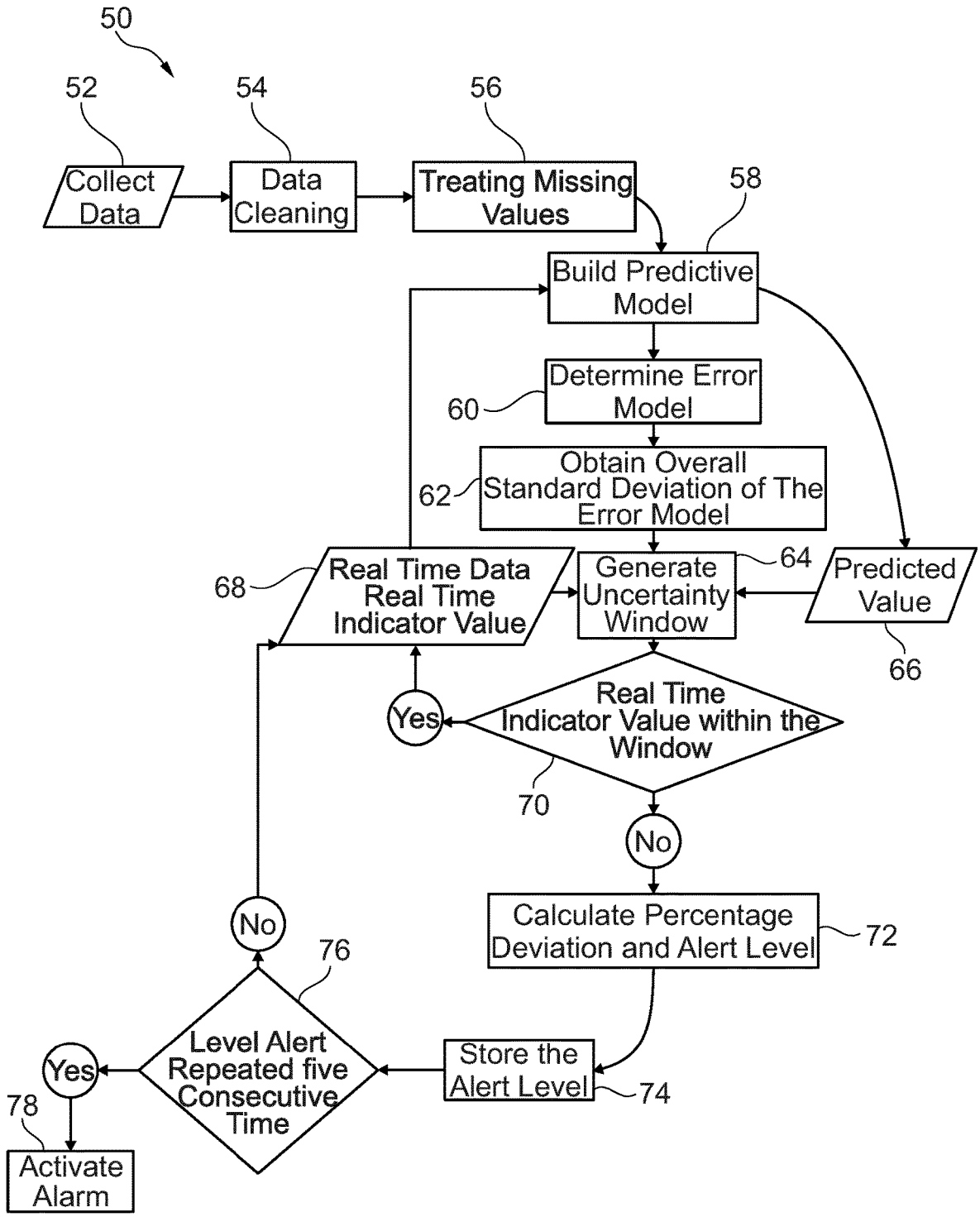
FIG. 7 is a flow diagram of a software program executed by a processor according to an exemplary embodiment of the invention to detect unfavourable drilling events, validate the existence of these events and generate alarms.

First referring to FIG. 7, the illustrated flowchart 50 will be explained. As can be taken from a block 52, data from the sensors 8-11 is firstly collected. In other words, sensor data may be measured during drilling according to block 52. In subsequent block 54, data cleaning may be carried out. This may involve data filtering, data reduction by removing redundant parts, and/or other pre-processing of the detected sensor data. As shown in a block 56, treatment of missing values of the pre-processed sensor data may then be done.

As shown in a block 58, a predictive model may then be built. For instance, elements of artificial intelligence or machine learning may be integrated in this context, such as random forest, a neural network, etc. In block 58, it may also be possible to classify potential downhole drilling events in various issue classes and to select one or more indexes for each issue class.

As can be taken from a subsequent block 60, an error model may then be determined. A standard deviation (and/or any other statistical parameter) may then be determined for the error model, see block 62.

A subsequent block 64 shows how an uncertainty window is thereafter generated for detected physical (and physical-chemical or chemical) parameters. Such an uncertainty window may be an operation window on the basis of which the detected sensor data can be tested. For instance, it may be assessed whether a detected value is inside or outside of the generated uncertainty window, wherein an alarm count or counter may be increased by one if the detected value is outside of the uncertainty window. In terms of generating the uncertainty window, also one or more predictive values, see block 66, may be considered. A predicted value may be an output of the predictive model built in block 58. Furthermore, as shown in a block 68, real-time data and a real-time indicator value may be considered for the generation of the uncertainty window in block 64. For generating the uncertainty window, a combination of machine learning and a probabilistic approach may be applied.

In a subsequent block 70, it may be determined whether a real-time indicator value is within or without the uncertainty window. If the real-time indicator value is not within the uncertainty window, i.e. is outside of the uncertainty window, a percentage deviation may be calculated, and an alert level may be modified (see block 72).

As shown in subsequent block 74, the modified alert level may then be stored.

If it is determined in a block 76 that a level alert is repeated for a predefined number of consecutive times (for instance 5 times or more), an alarm may be activated, see block 78. In other words, if more than a predefined number (for instance 5) of data points (see FIG. 11) is outside of the uncertainty window, the alarm may be triggered.

Figure 8:
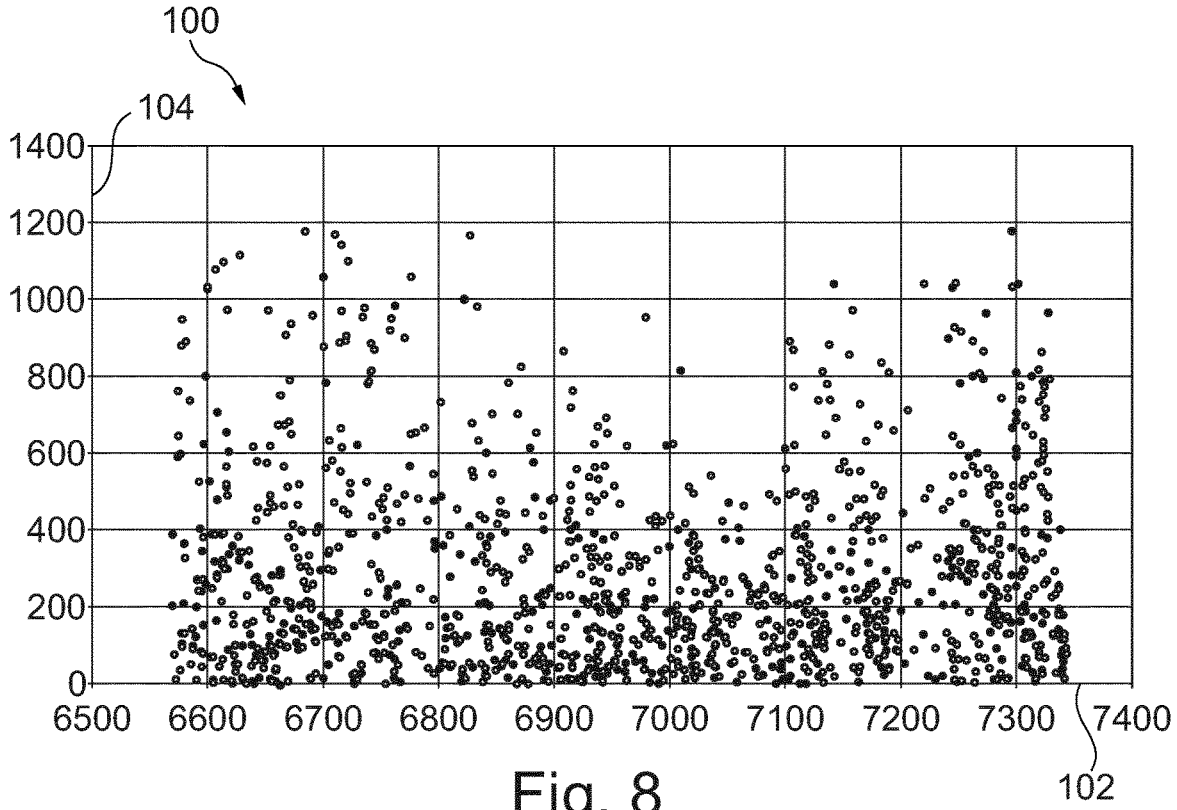
FIG. 8 illustrates a Root Mean Square Errors (RMSEs) versus total depth generated by torque predictive model according to an exemplary embodiment of the invention.

FIG. 8 shows a diagram 100 having an abscissa 102 along which a depth (in feet) is plotted. Along an ordinate 104, a Root Mean Square Error (RMSE) is plotted. Two different sets of data points can be distinguished in FIG. 8.

Figure 9:
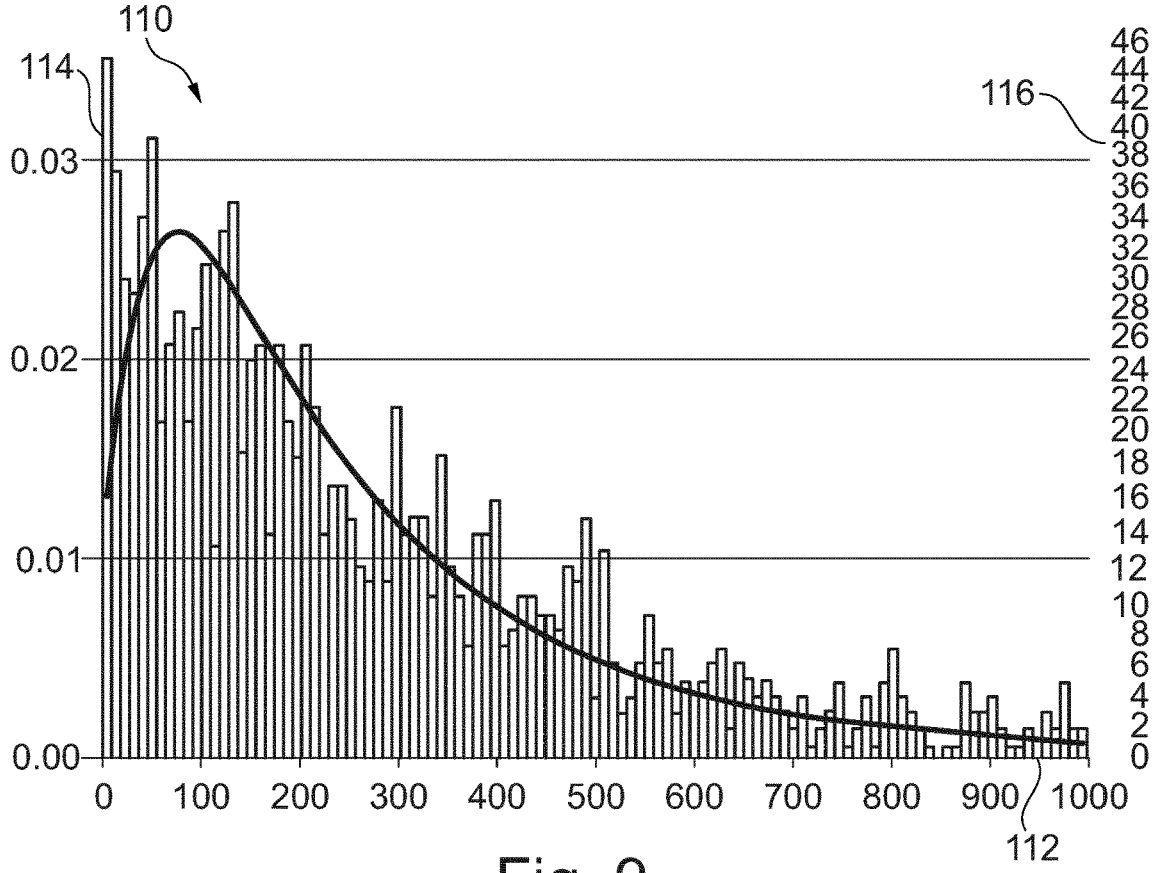
FIG. 9 shows a histogram generated by the RMSEs of FIG. 8 and indicates a best probability distribution model which has been selected for this data according to an exemplary embodiment of the invention.

FIG. 9 shows a diagram 110 having an abscissa 112, a first ordinate 114, and a second ordinate 116. Along the first ordinate 114, a probability is plotted. Along the second ordinate 116, a frequency is plotted. FIG. 9 shows a logarithmic normal distribution.

Figure 10:
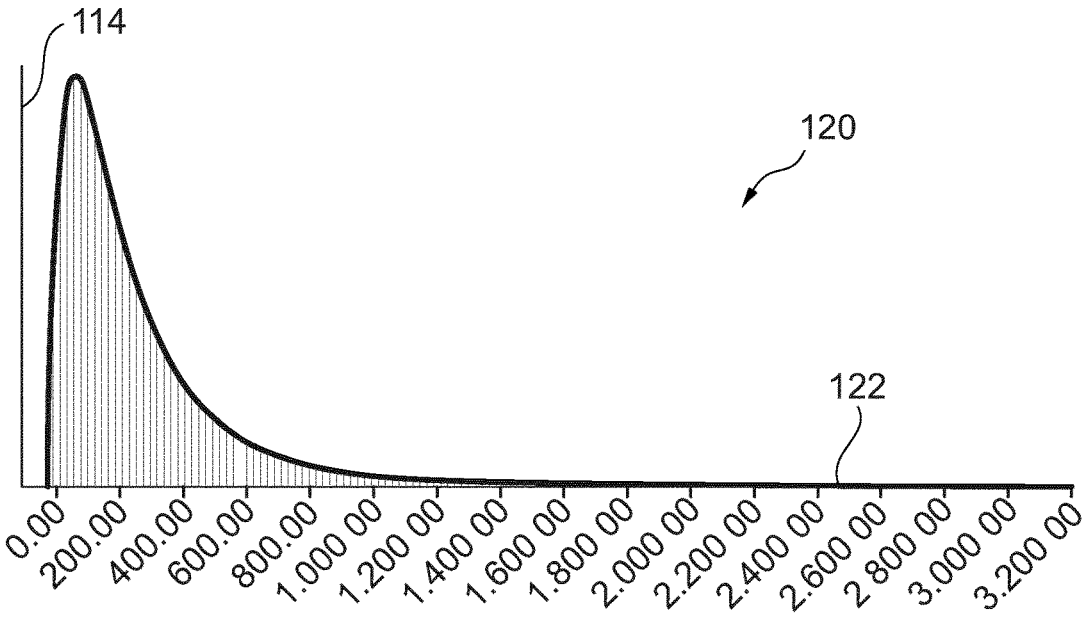
FIG. 10 indicates a standard deviation (SD) of the selected RMSEs model according to an exemplary embodiment of the invention.

Correspondingly, a diagram 120 in FIG. 10 shows a probability distribution. Along an abscissa 122, a Mean Square Error (MSE) is plotted, whereas the probability is plotted again along ordinate 114.

Figure 11:
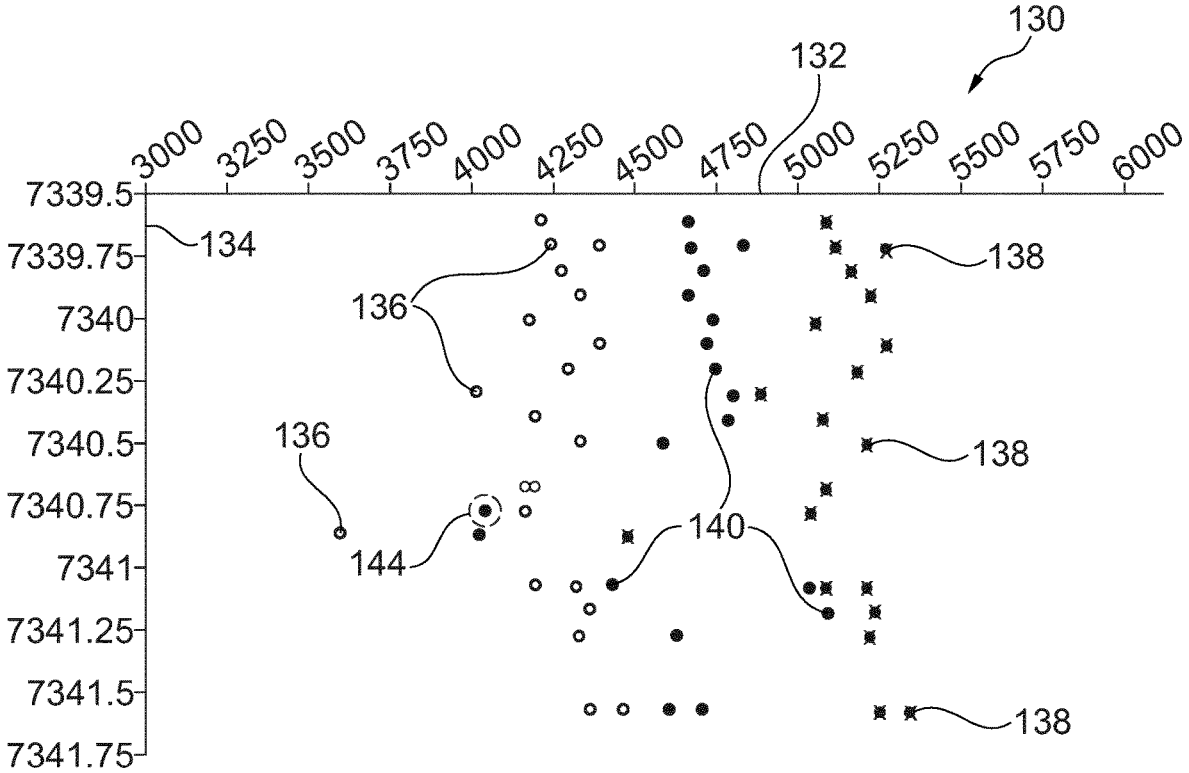
FIG. 11 demonstrates construction of a one dimensional uncertainty window for multiple data points according to an exemplary embodiment of the invention.

FIG. 11 shows a further diagram 130 illustrating the above-described concept of an uncertainty window. Along an abscissa 132 of diagram 130, torque (in lb ft) is plotted, as an example for a detectable physical parameter. Along an ordinate 134, a depth is plotted (in ft). A number of data points are plotted in the diagram 130 of FIG. 11. A first set of data points 136 corresponds to a lower limit of the physical parameter (torque in the shown example). With reference sign 138, a respective upper limit of the physical parameter is shown. As shown as data points 140, actually measured torque values are plotted. In the shown example, many of the actually plotted values 140 are situated between the lower limit (see reference sign 136) and the upper limit (see reference sign 138). However, other data points, see reference sign 144, may be outside of the uncertainty window. In the latter scenario, a counter for triggering an alarm when exceeding a predefined threshold value may be increased by one, since this indicates that the measured data point is out of a normal range of values. FIG. 11 is an example for a one-dimensional uncertainty window. However, an uncertainty window may be also multi-dimensionally, see FIG. 14 as an example of a two-dimensional uncertainty window.

Figure 12:
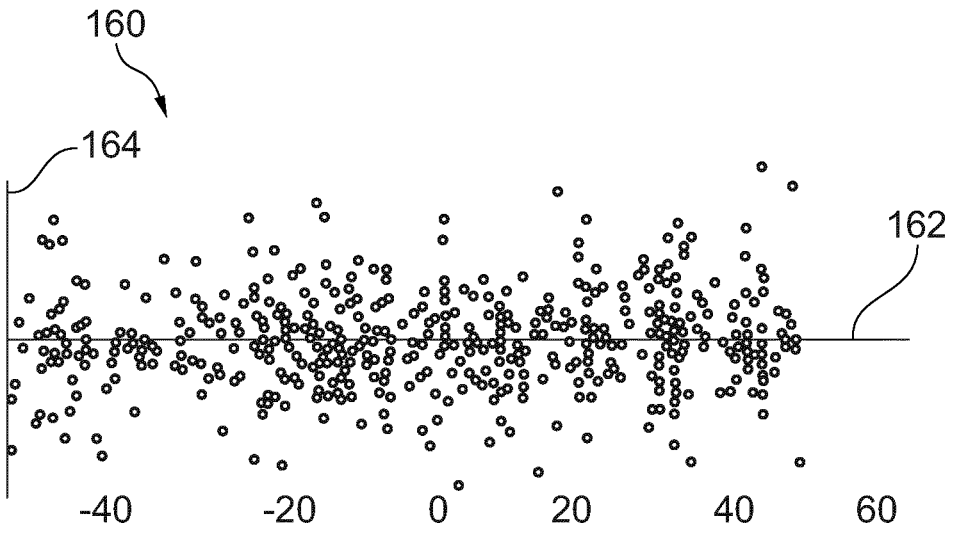
FIG. 12 shows residual errors of two variables, torque and standpipe pressure, according to an exemplary embodiment of the invention.

FIG. 12 shows a diagram 160 illustrating residual errors for the physical parameters torque and standpipe pressure. Along an abscissa 162, a torque residual error is plotted. Along an ordinate 164, a standpipe pressure residual error value is plotted.

Figure 13:
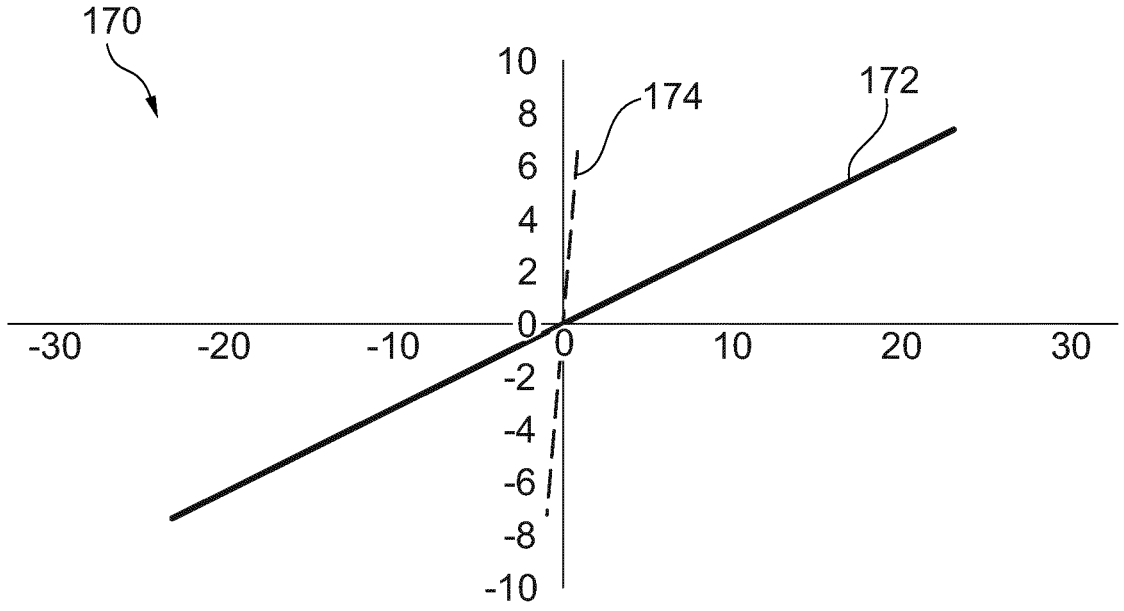
FIG. 13 illustrates a major axis and a minor axis of an ellipse of uncertainty according to an exemplary embodiment of the invention.

FIG. 13 shows a diagram 170 having a major axis 172 and a minor axis 174. The major axis 172 corresponds to a first result of an Eigenvalue and an Eigenvector of a matrix calculated according to a concept described below. The minor axis 174 shows a second result of a corresponding estimation of Eigenvalue and Eigenvector.

Figure 14:
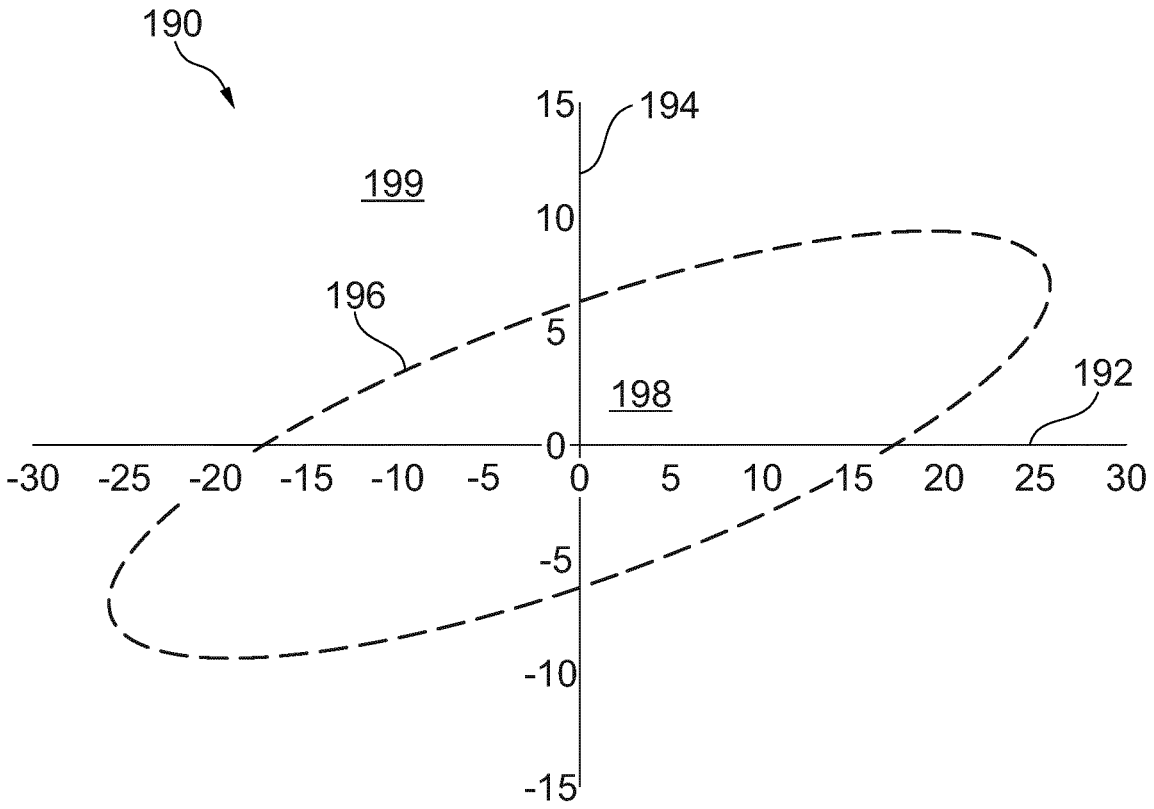
FIG. 14 illustrates a two-dimensional uncertainty window, developed for torque and standpipe pressure, according to an exemplary embodiment of the invention.

Now referring to FIG. 14, a diagram 190 is shown which illustrates a two-dimensional uncertainty window. Along an abscissa 192, a first detected physical parameter is plotted, for instance torque. Along an ordinate 194, a second detected physical parameter is plotted, for instance standpipe pressure. The diagram 190 shows a closed line or boundary line 196 indicating the border between values inside of the two-dimensional uncertainty window and outside the two-dimensional uncertainty window. In the range of parameter value combinations indicated with reference sign 198, i.e. inside line 196, the parameter combination is considered to be within an expected or normal range of values. If however the combination of in this case two parameter values is outside line 196, i.e. in area 199, this can be the indication of an abnormal behaviour and therefore the presence of a downhole drilling event.

Hence, in the example of FIG. 11 of a one-dimensional uncertainty window, one parameter is compared with a range of values which are considered as normal. In the two-dimensional uncertainty window according to FIG. 14, a normal range is an area, see reference sign 198. In case of a three-dimensional uncertainty window (not shown), the range of acceptable or normal values of the combination of three physical, physical-chemical or chemical parameters may be a three-dimensional geometric figure such as a three-dimensional ellipsoid.

According to an embodiment, a computer-readable medium is provided, in which a computer program of detecting a downhole drilling event based on sensor data sensed by the plurality of sensors 8-11 during a drilling operation by drill pipe 6 being partially surrounded by tubular 2 is stored. Said computer program, when being executed by processor 32, is adapted to carry out or control a method which will be described in the following in further detail. A corresponding program element may be provided as well.

According to the executed method, possible downhole drilling events, to be sensed by the sensors 8-11, may be classified into a plurality of issue classes. Each issue class may be indicative of an assigned issue level of an assigned downhole drilling event. Preferably, the issue classes comprise at least a major issue class and a minor issue class, the latter having a lower issue level than the major issue class. One or more additional issue classes may be defined as well.

Furthermore, the method may comprise defining one or preferably more than one indexes for each of said issue classes. Each index may correspond to a detectable parameter or parameter value in the presence of an assigned downhole drilling event. Preferably, the indexes comprise one or more main indexes (which may relate to one or more detectable parameters which may be considered as the most relevant parameter for an assigned downhole drilling event) and one or more secondary indexes (which may relate to one or more other detectable parameters which may be considered as being additionally pertinent, but less relevant parameters for an assigned downhole drilling event).

Furthermore, the method may comprise determining a downhole drilling event by a combination of three elements: Said three elements may be (i) the sensor data captured by sensors 8-11, (ii) a predictive model which may be applied for each index, and (iii) a one or more dimensional uncertainty window being related to the one or more indexes. The predictive model may be a model, which may involve elements of artificial intelligence such as machine learning, and which may make a prediction concerning a potentially present downhole drilling event. Finally, the uncertainty window may define a range of values of a physical parameter sensed by the sensors 8-11 or derived from sensor data as captured by the sensors 8-11, which range of values is considered as a normal or acceptable range. Descriptively speaking, the more sensor data indicate that the arrangement 30 is presently outside of the one or multi-dimensional uncertainty window, the higher may be the probability of the presence of an undesired downhole drilling event as may be predicted by the predictive model. More specifically, the software-based method executed by processor 32 may further comprise determining the downhole drilling event by a probabilistic model which accepts a potential downhole drilling event as an actual downhole drilling event when a determined probability for the presence of the potential downhole drilling event meets a predetermined confidence level. Only as an example, the predetermined confidence level may correspond to a pair of Percentile parameters, such as a P10 parameter in combination with a P90 parameter. The probabilistic model may be built using a statistical reliability parameter of the predictive model (for instance a root mean square error, R-squared, adjusted R-squared, root mean squared logarithmic error, a mean absolute error, etc.). Advantageously, the above-mentioned one or multi-dimensional uncertainty window may be generated or created based on a predictive value of the one or more indexes and based on the probabilistic model.

The described method may further comprise triggering an action based on a comparison of an actual value of the index(es) with the uncertainty window(s). More specifically, the method may comprise triggering an action which may be a continuation of drilling when no undesirable downhole drilling event is detected, stopping drilling when an undesirable downhole drilling event is detected, or outputting an alarm when an undesirable downhole drilling event is detected. Additionally or alternatively, other actions may be taken as well.

According to a preferred embodiment, the method comprises increasing an alarm count or counter each time a value of an index detected by the sensors 8-11 is outside of the assigned uncertainty window (see for instance FIG. 11). An alarm may then be triggered when a level of the alarm count or counter exceeds a predetermined threshold value. Advantageously, a counting loop may be used for triggering an event, and in particular for triggering an alarm. Said event may be triggered when a number of index based events counted by the counting loop reaches a predetermined number.

In the following, a more detailed overview of an embodiment of the software (which may also be configured as a hybrid model) will be given:

According to preferred embodiments of the present invention, the mentioned software may build an integrated system which can be used to analyse the drilling data that are generated by the sensors 8-11 involved in the hardware part of the embodiment of FIG. 1 to FIG. 6. However, such a software-based method may also be carried out based on sensor data detected by other drilling rig sensors for identifying and predicting symptoms of drilling problems which may occur while drilling when the drilling bit is on bottom and drilling is in progress. Such a software-based method may also enhance drilling efficiency through the use of additional channels, such as drilling fluid density and/or viscosity. A software-based method according to an exemplary embodiment of the invention may be advantageously combined with a probabilistic approach and with a data-driven approach, in particular to overcome shortcomings of each individual approach.

Combining the two approaches may outperform conventional methods because the overall sensor data discrepancy may be taken into consideration. Furthermore, it may be possible to reduce uncertainties associated with the prediction of drilling parameters. Beyond this, it may be possible to reduce false alarms. Also the impact of data errors may be reduced.

Examples of undesired downhole drilling events, i.e. drilling problems, to be detected and verified are listed in Table 1 below. The various downhole drilling events have been classified into two groups or issue classes; the first group or issue class is called major issues, whereas the second group or issue class is called minor issues.

TABLE 1

Examples of undesired downhole drilling events

| Major Issues | Minor Issues |
|---|---|
| Stuck Pipe | Hole Cleaning |
| Losses | Twist off |
| Kick | Bit balling |
| Tight Hole | |
| Washout | |
| Hole Collapse | |

For each issue or issue class, one or more indexes may be selected, compare Table 2. Preferably, there may be one main index, whereas the other indexes may be secondary indexes. For instance, if the losses are taken as example, the main index may be the flow-out and the secondary indexes may be standpipe pressure and fluid level. Table 2 shows the indexes selected for each issue according to Table 1.

TABLE 2

Indexes for different issues, events or incidents

| Issue, Event or Incident | Main Index | Secondary Index |
|---|---|---|
| Stuck Pipe | Torque | Standpipe Pressure, Fluid density and Viscosity, Hock load |
| Losses | Flow-out | Standpipe Pressure, Fluid Level |
| Kick | Flow-out | Standpipe Pressure, Fluid Level |
| Tight Hole | Torque | Standpipe Pressure, Hock load |
| Washout | Standpipe Pressure | Flow-out, Fluid density and Viscosity |
| Hole Collapse | Torque | Standpipe Pressure, Flow-out |
| Hole Cleaning | Torque | Standpipe Pressure, Hock load, Fluid density and Viscosity |
| Twist off | Standpipe Pressure | Hock load, Fluid density and Viscosity |
| Bit balling | Standpipe Pressure | Rate of Penetration, Fluid density and Viscosity |

For each specified index, a predictive model based on a data driven approach may be developed. The resultant Root mean square errors (RMSEs) of the generated model may be utilized to build a probability density function. Based on the resulting probability density function a best probability model which best fits the data can be selected. The statistic properties of the selective model and the real time predictive value of the index may be used to generate an uncertainty window. Said indicated uncertainty window can have one, two, three or more than three dimensions, depending on the number of indexes used. By comparing the actual value of an index with the uncertainty window, it can be decided whether it is safe to continue drilling or whether an undesirable event may encounter if no measures are taken on time.

In the following description of a preferred embodiment of the present invention in terms of an evaluation method, reference is made in particular to FIG. 4, FIG. 5, FIG. 6, FIG. 7 and FIG. 8. For better illustration of embodiments of the invention, the torque (TOR) is chosen as index and total depth (TD), weight on bit (WDB), revolution per-minute (RPM), stand-pipe pressure (SPP), rate of penetration (ROP) and flow-in (FLI) as attributes. In the following, a detailed explanation about building a one dimensional uncertainty window will be given, whereas multi-dimensional uncertainty windows are described subsequently.

What concerns data collection, relevant and sufficient real time data may be collected depending on the data resolution and drilling speed. If the data resolution is 5 seconds, drilling for two hours may generate 1440 data points, which may be a proper basis for building a predictive model. Other data repetition rates and drilling intervals are possible.

Next, data cleaning and treating missing values will be explained.

The collected data may be carefully examined to filter out those examples that potentially can deteriorate the analysis and prediction. This may involve reducing the data size by removing examples or attributes with missing data or redundancy. In this context, a proper method to identify and treat both outliers and noises may be implemented.

In the following, development of a predictive model will be explained.

Once the quality control of the data is completed, the training data sets may be finally ready to be processed to create a predictive model. In order to find an optimal algorithm, several algorithms may be evaluated based on appropriate performance evaluation tools.

Since the processing time is a relevant element for real time prediction, a number of predictive models may be generated based on one or more chosen algorithms and improved or even optimized simultaneously. A sub algorithm may then assess and compare the performances of all generated models, and preferably the best matching predictive model may be selected.

In the following, an identification of a probability distribution of Root Mean Square Errors will be explained.

Once a definitive predictive model has been selected, the predicted data points $P_{Pridected}$ and the actual data points $P_{actual}$ (i.e. the predicted data which correspond to the actual data points) may be extracted. The extracted data may be used to compute the Root mean square error (RMSE) or absolute error (AE) for each individual data point as follows:

$$RMSE=\sqrt{(P_{actual}-P_{Pridected})^2}$$

$P_{actual}$ is the actual data used to develop the predictive model. $P_{Pridected}$ is the corresponding predicted data produced by the predictive model. As next process, a histogram of the data may be generated. From there, a best probability distribution model can be obtained. For the described embodiment, the best probability distribution model that was proposed for this particular data is a lognormal distribution.

In the following, computation of an overall standard deviation will be explained.

Based on the RMSE model, the standard deviation of the model can be determined. In the present embodiment, the obtained standard deviation of the model is denoted as overall standard deviation (OSD). For the illustrative example, the OSD is 346.27.

Next, construction of an uncertainty window will be explained.

Newly generated drilling data detected by sensors 8-11 may be fed to the predetermined predictive model. Hence, a new predictive value for the index of interest may be generated. By utilizing the new predictive value and overall standard deviation, a probability model for this data point can be developed. To develop the probability model, the predictive value may be used as mean, and overall standard deviation may be used as standard deviation for the prospective probability model. The prospective probability model is preferably the same as the probability model which has been selected for RMSEs data.

Once the prospective probability model is generated, an upper and a lower limit of the uncertainty window can be determined. For instance, the values of P10 and P90 of the prospective probability model may represent the upper and lower limit of the uncertainty window, respectively. As an alternative, P20 and P80 of the prospective probability model can be used to obtain the limits of the uncertainty window, or P30 and P70.

By having determined the uncertainty window, a safe operational window can be specified. It may exemplify all the values which trapped between the upper and lower limit of the uncertainty window. Now the actual data of the used index can be compared with a safe operational window. If the actual data is located within the uncertainty window, then it may be classified as safe. If the actual data is however located outside the uncertainty window, then it may be classified as unsafe, and in this case a percentage deviation factor may be calculated.

In the illustrative example, P10 and P90 can be used as upper and lower limit for the uncertainty window(s). As can be seen in FIG. 11, only two points may be marked as unsafe, where the actual torque values were less than the expected safe operational range.

Next, computation of an alert level will be described.

Preferably, the alert system may be divided into two stages. In a first stage, a percentage deviation factor may be calculated. In a second stage, an alert level value may be produced.

In this context, a percentage deviation (PD) can be calculated as follows, wherein ABS denotes an absolute value:

$$PD = \text{ABS}\left(\frac{P_{actual} - P_{Pridected}}{P_{Pridected}}\right) * 100$$

For an alert level (AL) the overall sensor data discrepancy may be used as a threshold for deviation calculations. The discrepancy means the difference between the expected values of parameters and the measured values of drilling parameters measured by the sensors 8-11. A value (sensor data discrepancy (%)) can be obtained when a sensor 8-11 is calibrated. Then, it may be possible to compute the alert level (AL) as follows:

$$AL = \left(\frac{PD}{\text{sensor data discrepancy (\%)}}\right)$$

The parameter "sensor data discrepancy (%)" may be a percentage (for example 5%, 7%, etc.). Once the value AL is calculated, based on the output number, the AL may be classified, for instance as low, medium or high. The classification may be based on multiple aspects. For the present embodiment, the following classification may be used:

| AL Value | 1 < AL < 2 | 2 < AL < 3 | 3 < AL |
|---|---|---|---|
| Classification | Low Risk | Medium Risk | High Risk |

In the following, alarm activation will be described.

Once the alert level AL is computed and classified, if it is for example classified as high, then the system may generate a counting loop. A function of this counting loop may be to count how many high values AL have been generated consecutively. If this number reaches a predetermined upper limit, an alarm may be triggered. The alarm may announce an expected drilling event which may be encountered.

In the following, an alternative method according to another exemplary embodiment will be described.

Several downhole issues can be indicated by two or more indexes. Thus, as explained previously, for a single downhole issue which can be indicated by more than one index, a number of one dimensional uncertainty windows may be generated. However, these uncertainty windows can be joined together and as a result, uncertainty windows with two or three or more dimensions can be constructed. A procedure of developing a multiple dimensional uncertainty window will be explained in the following. In this context, reference is made in particular to FIG. 12, FIG. 13 and FIG. 14.

The process of developing the predictive models are the same as explained for constructing an uncertainty window with one dimension. The only difference here is that, more than one predictive model may be generated, for instance if a stuck pipe event is used as an example. In such a scenario, two predictive models may be built, for instance one to predict torque, whereas the other one may predict standpipe pressure.

In the following, the identification of a probability distribution of residual errors will be explained.

The process of selecting the best probability distribution model are the same as explained for constructing an uncertainty window with one dimension. A difference here is however that more than one probabilistic model may be generated eventually. Once the probabilistic models are built, the uncertainty level for each model can be selected. For instance, it can be a one sigma level, a two sigma level, etc.

Next, a variance covariance matrix for residual errors may be constructed.

Once the uncertainty levels are selected, a next process may be to use the residual error (ER) data for involved models to build a variance covariance matrix (VCM). The size of the variance covariance matrix may be depending on the number of models, referring to the stuck pipe example, since two models are used. Then, the size of the variance covariance matrix may be 2×2. In this case, the variance covariance matrix may contain the variances of residual errors of the torque predictive model ($Var_{ER\text{-}Torque}$) and variances of residual error of the standpipe pressure predictive model ($Var_{ER\text{-}Standpipe\ Pressure}$) on the main diagonal, and covariances between the two residual errors outside the main diagonal ($Cov_{ER\text{-}Torque\&ER\text{-}Standpipe\ Pressure}$).

$$VCM = \begin{Vmatrix} Var_{ER-Torque} & Cov_{ER-Torque\ \&\ ER-Standpipe\ Pressure} \\ Cov_{ER-Torque\ \&\ ER-Standpipe\ Pressure} & Var_{ER-Standpipe\ Pressure} \end{Vmatrix}$$

For the illustrated example, the variance covariance matrix VCM generated by the data shown in FIG. 12 is:

$$VCM = \begin{Vmatrix} 734 & 20 \\ 20 & 37 \end{Vmatrix}$$

Next, Eigenvalue and Eigenvector of the variance covariance matrix may be calculated.

To calculate the dimensions of an uncertainty window, the above variance covariance matrix may be further converted to its Eigenvectors (er) and Eigenvalues (A) through matrix manipulation. Eigenvectors define the direction of the ellipse of uncertainty, whereas the Eigenvalues define their magnitudes. Since the used example has a 2×2 variance covariance matrix, two Eigenvectors (er) and two Eigenvalues (A) can be computed, see Table 3.

TABLE 3

| Eigenvectors and Eigenvalues | |
|---|---|
| Eigenvalue | Eigenvector |
| 735 | (1, 0.07) |
| 37.2 | (1, −15) |

In the following, it will be described how the uncertainty window can then be constructed.

By using the Eigenvalues and Eigenvectors and utilizing mathematical formulas for constructing an ellipse, an uncertainty window can be generated. Going back to newly generated drilling data, by feeding these data to the predetermined predictive models, a new predictive value for each index of interest may be generated. For instance, using the stuck pipe as example, two predictive values may be generated, one for torque ($TOR_{Pridected}$) and one for standpipe pressure ($SPP_{Pridected}$). This pair of coordinates and the current depth (Dep) can be plotted in a three dimensional cartesian coordinate system. If the point generated by $TOR_{Pridected}$ $SPP_{Pridected}$ within the global three dimensional cartesian coordinate considered to be an origin for a local two dimensional cartesian coordinate, a two-dimensional uncertainty window (i.e. a safe operational window) developed in the previous processes can be built around this point. Now the actual data of the used indexes can be compared with the safe operational window. If the actual data is located within the window, then it is classified as safe, if in contrast to this the actual data is located outside the window, then it is classified as unsafe. In the latter case, a percentage deviation factor may be calculated, as explained earlier.

In the following, some aspects of embodiments of the invention will be summarized:

An embodiment of the invention provides an arrangement 30 for improving the precision of detection and verification of undesirable downhole drilling events and comprises a sensors holder 4 hanged inside a substantially vertical tubular 2 by means of hydraulic rods 5 located at the top of substantially vertical tubular 2. A low pressure rotating sealing element 7 may be integrated to lower part of the sensor holder 4. A couple of sensors 8-11 may be constructed into each bisection 4*a*, 4*b* of the sensors holder 4. A level measurement device 10 may be installed at the top of the substantially vertical tubular 2. Said substantially vertical tubular 2 may be a bell nipple or a marine riser. Said sensors holder 4 may have a circular shaped pipe or another geometrical shape. A couple of multiphase flowmeters 11 and a couple of temperature sensors 9 may be constructed into each bisection 4*a*, 4*b* of the sensors holder 4. Said more than two multiphase flowmeters 11 and temperature sensors 9 may be constructed into each bisection 4*a*, 4*b* of the sensors holder 4. Said device or sensors 8-11 may be installed, built or coupled to the sensors holder 4. Opening and closing movements of the sensors holder 4 may be done by hydraulic rods 5. Different mechanisms may be used to open and close the sensors holder 4. A pair of magnetic elements 13 may be located at the top and the bottom of each half of the sensors holder 4 to support the stability of the sensors holder 4. A different method may be used to strengthen the stability of the sensors holder 4. A low pressure rotating sealing element 7 may be integrated to lower part of the sensor holder 4. It may be possible to position the low pressure rotating sealing element 7 in place which is at the lower part of the sensors holder 4 by sliding it down from the rig floor 16. Different techniques may be used to set low pressure rotating sealing element 7.

Furthermore, a rigorous method for detecting and verifying undesirable downhole drilling problems may be provided, wherein the method may comprise an integral system combined probabilistic approach with data-driven approach, and the use of resulting root mean square errors from the predictive model to build a probabilistic model. Furthermore, it may be possible to generate an uncertainties window using the P10 and P90 parameters. Moreover, it may be possible to generate a counting loop for triggering an alarm. Apart from this, it may be possible to construct multi-dimensional uncertainty windows using residual errors generated by predictive models. Root mean square error may be used to construct a proper probabilistic model. It is also possible to use another model evaluation metrics for machine learning, such as R-Squared, Adjusted R-Squared, Root Mean Squared Logarithmic Error and Mean Absolute Error to construct a proper probabilistic model. An uncertainties window may be established using the P10 and P90 parameters. Utilization of other twins parameters, such as P20 and P80, P30 and P70, may also be possible to generate the uncertainties window. A counting loop may be used for triggering the alarms. In particular, the alarm may be activated when the counted number of deviations reaches the predetermined number. The predetermined number has no limitation and can be any figure.

Finally, it should be noted that the above-mentioned embodiments illustrate rather than limit the invention, and that those skilled in the art will be capable of designing many alternative embodiments without departing from the scope of the invention as defined by the appended claims. In the claims, any reference signs placed in parentheses shall not be construed as limiting the claims. The words "comprising" and "comprises", and the like, do not exclude the presence of elements or steps other than those listed in any claim or the specification as a whole. The singular reference of an element does not exclude the plural reference of such elements and vice versa. In a device claim enumerating several means, several of these means may be embodied by one and the same item of software or hardware. The mere fact that certain measures are recited in mutually different dependent claims does not indicate that a combination of these measures cannot be used to advantage.

The invention claimed is:

1. An arrangement for detecting a downhole drilling event during a drilling operation by a drill pipe, wherein the arrangement comprises:

a tubular, which is a sleeve-shaped member to be installed on top of a blowout preventer (BOP);

a sensors holder to be mounted inside of the tubular and to be mounted to surround part of the drill pipe;

a plurality of sensors for sensing sensor data indicative of downhole drilling events, wherein at least part of the sensors are mounted on the sensors holder; and a processor configured for processing the sensor data to thereby detect the downhole drilling event, wherein the sensors holder is composed of multiple sections being selectively openable or closable, wherein the arrangement comprises a mounting fixture, with one or more rods, with at least one of hydraulic rods, mechanically activated rods, and electrically activated rods, connected to the sensors holder and connected to the tubular, wherein the mounting fixture is operable for selectively opening or closing the sections of the sensors holder.

2. The arrangement of claim 1, wherein the mounting fixture is connected to a top portion of the sensors holder and connectable to a top portion of the tubular.

3. The arrangement of claim 1, wherein the mounting fixture and the sensors holder are configured for hanging the sensors holder in the tubular.

4. The arrangement of claim 1, wherein the mounting fixture is resiliently connected to the sensors holder.

5. The arrangement of claim 1, wherein a sealing element connected or connectable to the sensors holder, is composed of multiple sections, being selectively openable or closable; and wherein at least one of the sensors is mounted at each section of the sensors holder.

6. The arrangement of claim 1, comprising a biasing mechanism, configured for biasing the sections into the closed configuration.

7. The arrangement of claim 1, comprising a sealing element arranged or arrangeable at the sensors holder for at least partially sealing the sensors holder against drilling fluid.

8. The arrangement of claim 7, comprising at least one of the following features:

wherein the sealing element is permanently arranged or variably arrangeable at a bottom portion of the sensors holder;

wherein the sealing element has a tapering exterior surface, and has a conical or frustoconical shape;

wherein the sealing element is made of or with an elastically deformable material;

wherein the sealing element is rotatable with respect to the sensors holder, which is stationary and/or together with the rotatable drill pipe.

9. The arrangement of claim 1, comprising at least one of the following features:

wherein the sensors comprise one or multiple level and flow monitor sensors configured for sensing a level of drilling fluid, wherein the processor is configured for processing sensor data provided by the level and flow monitor sensor linked with surface data indicative of a surface level;

wherein the sensors comprise at least one of the group consisting of a flowmeter, a temperature sensor, a fluid viscosity sensor, a fluid density sensor, and a pressure sensor;

wherein the sensors holder has a tubular shape;

wherein the downhole drilling event is an undesirable downhole drilling event at least one of the group consisting of losses, kicks, stuck pipe, string failure, and well bore instability;

wherein the processor is configured for controlling or carrying out a computer program of a computer-readable medium.

10. A downhole drilling apparatus, wherein the downhole drilling apparatus comprises:

a rotatable drill pipe configured for downhole drilling in a drill hole and for supplying drilling fluid to the drill hole;

wherein the tubular which surrounds the drill pipe; and an arrangement of claim 1 for detecting a downhole drilling event during a drilling operation by the drill pipe.

11. The downhole drilling apparatus of claim 10, comprising at least one of the following features:

wherein the tubular is arranged substantially vertically, wherein the tubular belongs to one of the group consisting of a bell nipple, and a marine riser;

wherein the tubular has a circular and/or ring-shaped cross-section;

wherein part of the sensors is built into or planted into the tubular;

comprising a mud return line extending from the tubular in a top portion of the sensors holder;

wherein the downhole drilling apparatus is configured for pumping drilling fluid through the drill pipe into the drill hole and back through an annular gap between the tubular and the sensors holder, and into a mud return line.

12. A method of detecting a downhole drilling event during a drilling operation by a drill pipe being partially surrounded by the tubular, using a downhole drilling apparatus of claim 10, wherein the method comprises:

mounting the sensors holder inside of the tubular and around part of the drill pipe;

arranging at least part of the plurality of sensors on the sensors holder;

operating the sensors for sensing sensor data indicative of downhole drilling events; and processing the sensor data with the processor to thereby detect the downhole drilling event.

* * * * *